US005965313A

United States Patent [19]

Mizutani et al.

[11] Patent Number: 5,965,313

[45] Date of Patent: Oct. 12, 1999

[54] TONERS FOR ELECTROPHOTOGRAPHY, DEVELOPERS FOR ELECTROPHOTOGRAPHY AND METHODS FOR FORMING IMAGES USING THE SAME

[75] Inventors: Noriyuki Mizutani; Chiaki Suzuki; Masahiro Takagi; Kaori Ohishi, all of Minamiashigara, Japan

[73] Assignee: Fuji Xerox Co., Ltd., Tokyo, Japan

[21] Appl. No.: 09/173,182

[22] Filed: Oct. 15, 1998

[30] Foreign Application Priority Data

Oct. 17, 1997 [JP] Japan ..... 9-285880
Mar. 31, 1998 [JP] Japan ..... 10-87748

[51] Int. Cl.[6] ..... G03G 9/097; G03G 13/20

[52] U.S. Cl. ..... 430/110; 430/111; 430/124

[58] Field of Search ..... 430/110, 111, 430/124

[56] References Cited

U.S. PATENT DOCUMENTS

| | | | |
|---|---|---|---|
| 4,842,972 | 6/1989 | Tavernier et al. | 430/119 |
| 4,853,311 | 8/1989 | Tavernier et al. | 430/111 |
| 5,518,848 | 5/1996 | Ito et al. | 430/109 |
| 5,620,826 | 4/1997 | Tavernier et al. | 430/137 |

FOREIGN PATENT DOCUMENTS

| | | |
|---|---|---|
| 1225967 | 9/1989 | Japan . |
| 2-37586 | 2/1990 | Japan . |
| A-2-101477 | 4/1990 | Japan . |
| 2235069 | 9/1990 | Japan . |
| A-4-186368 | 7/1992 | Japan . |
| 6258869 | 9/1994 | Japan . |
| 8044107 | 2/1996 | Japan . |

*Primary Examiner*—Roland Martin
*Attorney, Agent, or Firm*—Oliff & Berridge, PLC

[57] ABSTRACT

A toner for electrophotography comprising a colorant and a binder resin, wherein the toner further contains an image reinforcing agent, is disclosed. The reinforcing agent is preferably a high melt viscosity resin whose weight average molecular weight is 300 to 3000 and whose melt viscosity $\eta$ at 140° C. is $10^3$ to $10^6$ (Pa·s). A developer for electrophotography containing a carrier and a toner comprising of a colorant and a binder resin, wherein the toner contains an image reinforcing agent, is also disclosed.

17 Claims, No Drawings

TONERS FOR ELECTROPHOTOGRAPHY, DEVELOPERS FOR ELECTROPHOTOGRAPHY AND METHODS FOR FORMING IMAGES USING THE SAME

BACKGROUND OF THE INVENTION

1. Field of Invention

The present invention relates to a toner for electrophotography also capable of being applied to an electrostatic recording method, a developer for electrophotography employed to develop an electrostatic latent image, and a method for forming an image employing the same.

2. Description of Related Art

In electrophotography, an electrostatic latent image formed on a photoconductor is developed using a toner containing a binder resin and a colorant, and a toner image thus obtained is transferred onto a transfer paper and fixed using a heating roll to obtain an image. A dry type developer employed in electrophotography can broadly be grouped into a one-component developer containing only toner, which is a colorant dispersed in a binder resin, or a two-component developer containing such toner together admixed with a carrier.

In late 1980's, a more compact device having higher performance was in demand in the electrophotography market, especially with regard to full color image quality where the quality equivalent to that of art printing or silver chloride photography is desired. Digital conversion is essential to achieve such high image quality, and it allows complicated image processing to be done rapidly. Digital conversion enables control of a character that is independent of a graphic image, and provides substantial improvement in image reproducibility when compared with analog technology. Especially with regard to a photographic image, it is very valuable that gradation correction and color correction are possible, and gradation characteristics, minute line reproducibility, sharpness, color reproducibility and graininess are also advantageous when compared with an analog image.

Recently, electrophotography began to also be employed in office printing, especially in DTP (desktop publishing) as a result of the advanced technology described above. In such case, on demand printing system is an advantageous property. However, such systems require a developer to give a correct output of a latent image originally formed in an optical system, which leads to the employment of a toner having a smaller particle size, which then gives rise to increased significance of improved basic characteristics in development, transfer and fixing.

A thermoplastic resin has conventionally been employed as a toner for electrophotography. For the purpose of achieving both low energy fixing and proper particulate blocking characteristics, the rheology and the glass transition point (hereinafter abbreviated as Tg) of a resin used as a toner is optimized as disclosed in Japanese Patent Application Publication No. 2-37586 and Japanese Patent Application Laid-Open No. 1-225967 and No. 2-235069. Among such optimized resins, one having a lower Tg is usually employed for toner for the office printing system described above because rapid fixing can be achieved.

However, an image formed using a toner obtained by the method described above undergoes melting of the resin component in the image region when subjected to heat at a temperature close to Tg or higher, resulting in adhesion of the resin onto the reverse side of a copy or onto another printing material, whereby causing a blank area in the image. In addition, in office printing, where two-sided printing is frequent, the image regions are in contact with each other, resulting in more frequent formation of blanks in the image when compared with one-sided printing.

For the purpose of office printing such as DTP as described above, the form of a printed material, which has frequently been subjected to two-sided printing and then bound into a book, makes the stability of the print quality over a prolonged storage period and during shipping very important.

Japanese Patent Application Laid-Open No. 4-186368, which is intended to avoid offset upon fixing, describes a method wherein a thermosetting resin is added externally to a toner and allowed to undergo a curing reaction with a polyester binder resin, whereby attempting to avoid offset upon fixing and attempting to improve low temperature fixing and OHP transparency. In this method, the polyester resin is melted upon fixing and the melted polyester undergoes crosslinking with a microparticle of an epoxy resin or a melamine resin to increase the internal cohesive force of a toner layer, whereby preventing offset upon fixing. By this method, it is actually possible to prevent offset as a result of increased internal cohesive force of the toner due to the partial crosslinking of the resin. However, in view of stability over a prolonged storage period and during shipping no sufficient print quality can be obtained. In addition, this method involves the problems of irregular image surface due to the partial increase in the pile height of the print image since the thermosetting resin microparticles undergo crosslinking between the thermosetting resin particles instead of crosslinking with a toner binder resin. Furthermore, this process also involves the problem of a blanked image due to the release of the crosslinked thermosetting resin microparticles from the image surface over a prolonged period of storage of the printed material, suggesting that it is not suitable to the office printing application.

Japanese Patent Application Laid-Open No. 2-101477 discloses a method in which the surface of a toner is cured with a polyurethane resin and an adhesiveness-imparting resin is contained internally together with a binder resin to achieve both anti-offset capability and low temperature fixing ability. In this method, the surface of an image becomes disadvantageously irregular due to curing of the toner surface. Accordingly no satisfactory print quality, in terms of stability over a prolonged storage period and during shipping, can be obtained.

The present invention is established in view of the current technical circumstance described above.

SUMMARY OF THE INVENTION

Accordingly, the present invention provides a toner for electrophotography capable of achieving satisfactory stability against heat, sufficient anti-offset ability upon fixing, and low energy fixing. In addition, in view of storage and shipping of a printed material, the present invention provides a toner capable of maintaining an image intact over a prolonged period against heat and load. The present invention is also directed to a developer for electrophotography containing such toner and a method for forming an image by which a satisfactorily stable table image can be formed using such a developer.

A toner for electrophotography according to the present invention is a toner containing a colorant and a binder resin, wherein the toner further contains an image reinforcing agent. The image reinforcing agent is preferably a high melt viscosity resin whose weight average molecular weight is 300 to 3000 and whose melt viscosity $\eta$ at 140° C. is $10^3$ to $10^6$ (Pa·s). Preferably, when solid images of 1×1 $cm^2$ formed by toner containing an image reinforcing agent are brought into contact under a temperature of 60° C. and a pressure of 30 g/$cm^2$ for 10 minutes, no blanks in the images are formed by adhesion of the images to each other.

In a preferred embodiment, the high melt viscosity resin is contained in an amount of 3 to 50 parts by weight when added internally or 0.3 to 20 parts by weight when added externally based on 100 parts by weight of the binder resin. In addition, preferably the softening point of the high melt viscosity resin is within the range from 100° C. to 150° C., the high melt viscosity resin does not have a definite endothermic peak when determined by a DSC:differential scanning calorimeter, the difference in SP value between the binder resin and the high melt viscosity resin added internally is 3 or less, the high melt viscosity resin when added externally is a resin microparticle having an average particle size of 0.05 to 1.0 $\mu$m, and/or the binder resin is a polyester resin.

The high melt viscosity resin preferably has the characteristics described above and the resin component is preferably one or more substances selected from the group consisting of novolac resins, modified novolac resins, copolymeric petroleum resins of aliphatic hydrocarbons and aromatic hydrocarbons having 9 or more carbon atoms, modified rosins, ester-derivatized modified rosins, terpene resins and C9 petroleum resins. A terpene-modified novolac resin is preferably employed.

The toner may be employed independently as a one-component developer, or may be employed as a two-component developer in admixture with a carrier.

However, it may mostly be employed as a two-component developer since two-component developers are often more suitable for rapid printing.

A two-component developer for electrophotography of the present invention contains a carrier and a toner, wherein the toner contains a colorant, a binder resin, and an image reinforcing agent, where the image reinforcing agent is preferably a high melt viscosity resin whose weight average molecular weight is 300 to 3000, preferably 500 to 2500 and whose melt viscosity $\eta$ at 140° C. is $10^3$ to $10^6$ (Pa·s).

In a preferred embodiment, the softening point of the high melt viscosity resin is within the range of from 100° C. to 150° C., and/or the carrier has a resin coating layer.

A method for forming an image of the present invention comprises a step in which an electrostatic latent image is formed on a latent image support, a step in which the electrostatic latent image is developed using a developer containing a toner retained on a developer retainer whereby forming a toner image, a step in which the toner image formed on the latent image support is transferred onto a transfer material and a step in which the toner image transferred onto the transfer material is heat-fixed, wherein the toner contains an image reinforcing agent. The image reinforcing agent is preferably a high melt viscosity resin whose weight average molecular weight is 300 to 3000 and whose melt viscosity $\eta$ at 140° C. is $10^3$ to $10^6$ (Pa·s).

It is preferable that the step in which the toner image transferred onto the transfer material is heat-fixed is conducted using a heating roll. This image forming method is particularly advantageous when used to form heat-fixed toner image on both sides of the transfer material. When the fixing step described above employs a heating roll, the surface temperature of the heating roll is preferably 150° C. or higher.

A high melt viscosity resin employed in a toner according to the present invention may be an amorphous oligomer having a molecular weight of several hundred to several thousand whose melt viscosity is somewhat higher in relation to its molecular weight. Preferably, the high melt viscosity resin is a resin exhibiting no definite endothermal peaks, i.e., exhibiting no Tg or exhibiting a glass transition temperature (Tg) not lower than room temperature. As a result, the resin shows excellent mobility (capability of being deformed easily) and readily permeates upon heat fixing into a binder resin having a high molecular weight and a low melt viscosity while exhibiting high compatibility with the binder resin, thus establishing a structure in a resulting image wherein the high melt viscosity resin pastes/binds the binder resin together, i.e., the toner particles with each other.

Such structure serves to increase the cohesive force of the entire image while increasing the apparent melt viscosity of the image at the same time.

The high melt viscosity resin undergoes almost no permeation into a transfer material due to its viscosity characteristics. In addition, the distribution in the direction of the image depth indicates that the relative % presence of the high melt viscosity resin is higher at the point closer to the image surface and in some parts the high melt viscosity resin is present on the surface. Accordingly, the apparent melt viscosity is higher at the point closer to the surface, which provides an effect similar to that experienced when the image surface is coated with the high melt viscosity resin. Presumably, this effect typically causes an increase in the internal cohesive force of an image rather than in the surface adhesiveness. As a result, the internal cohesive force in the image is higher than the adhesiveness between an image surface and the plane facing it, i.e., the surface of another image or a paper used as a transfer material, even stored at a high temperature, resulting in the prevention of a blank in the image.

Also when a resin microparticle is added externally to a mother toner, a resin microparticle present inside of an unfixed image serves to paste/bind as described above and a resin microparticle added externally to the toner, which is located on the outermost surface of the unfixed image, is fused upon heat fixing to spread uniformly over the entire surface of the image, whereby eliciting the effect described above.

Preferably, the high melt viscosity resin has a softening point as high as 100° C. to 150° C., which allows a toner and a toner image to be kept intact without adhesion after fixing and during storage. Accordingly, by using a high melt viscosity resin, the cohesive force of a toner image is increased and the toner image itself adheres or binds firmly to a transfer material, resulting in a marked image blank preventing effect, even when a printed material is kept at a relatively high heat storage temperature.

Theoretically, the force of binding between toner particles or between a toner and a transfer material is in proportion with molecular weight, and the addition of a resin having a molecular weight which is smaller when compared with a binder resin results in reduction in the average molecular weight of the system, which is considered to affect the adhesion force adversely. However, a polymer having a high molecular weight affects the mobility of the system adversely and allows only a limited valid contact area to be formed upon heat fixing between the toner particles or between the toner and the transfer material, which can be overcome somewhat by pressurization upon fixing but cannot be overcome in the case of rapid fixing. Accordingly, as practiced in the present invention, by adding an amorphous oligomer having a low molecular weight, the ability to be deformed can be improved and an increased contact area can be achieved whereby an apparent adhesion force is increased, although the average molecular weight is somewhat reduced.

Also by employing, as a high melt viscosity resin according to the present invention, one or more substance selected from the group consisting of novolac resins, modified novolac resins, copolymeric petroleum resins of aliphatic hydrocarbons and aromatic hydrocarbons having 9 or more carbon atoms, modified rosins, ester-derivatized modified rosins, terpene resins and C9 petroleum resins, the compatibility with a binder resin is increased and the adhesive force between toner particles or between a toner and a transfer material can further be increased, whereby achieving a more marked effect. In particular, a terpene-modified novolac resin can efficiently be employed to prevent the formation of a blank in an image area by means of the terpene-modified novolac resin layer, which protects the image area even when the printed material is kept at a relatively high heat storage temperature, since it has no Tg and has a melting point of 100° C. or higher.

A high melt viscosity resin increases the cohesive force of a toner image upon fixing as described above, and by using a resin having no Tg or having a Tg not lower than room temperature, the high melt viscosity resin is allowed to be in solid form during storage of the image, whereby binding the toner particles and keeping a fixed immobilized condition.

Also in a method for forming an image according to the present invention, by using a toner described above or a developer containing the same, a relatively firm image surface can be obtained and an image quality that is stable to heat can be realized while causing no substantial increase in the pile height of the printed image.

DETAILED DESCRIPTION OF PREFERRED EMBODIMENTS

A toner for electrophotography according to the present invention contains an image reinforcing agent. The image reinforcing agent functions to make images difficult to adhere to each other even if toner-fixed images are piled up. Preferably, when solid images of 1×1 $cm^2$ formed by toner containing an image reinforcing agent are brought into contact under a temperature of 60° C. and a pressure of 30 $g/cm^2$ for 10 minutes, no blanks in the images are formed by adhesion of the images to each other.

The image reinforcing agent is preferably a resin having specific physical properties, and such specific resin serving to improve the characteristics of the entire toner is referred herein to as "a high melt viscosity resin." Such a high melt viscosity resin has a weight average molecular weight of 300 to 3000 and a melt viscosity η at 140° C. of $10^3$ to $10^6$ (Pa·s), i.e., it is characterized by its large melt viscosity in spite of its relatively small molecular weight. This high melt viscosity resin is present as added internally or externally to a toner. When added internally, it should preferably have an SP value that is different from the SP value of the binder resin by 3 or less and it should be highly compatible with the binder resin.

The melt viscosity η of a resin referred herein is a value (Pa·s) determined using a flow tester (SIMADZU Model CFT-500C) with pre-heating for 300 seconds, at a pressure of 0.980665 MPa, with a die size of 1 mm ID×1 mm, at a heating rate of 3.0° C./min at a certain temperature (140° C. in the present invention). The melt viscosity η at 140° C. should be $10^3$ to $10^6$ (Pa·s), preferably $10^{3.5}$ to $10^{4.5}$ (Pa·s) for the purpose of satisfactory compatibility with a binder resin and satisfactory dispersion in a binder resin. A melt viscosity η less than $10^3$ (Pa·s) may cause disadvantageous permeation into a transfer material and insufficient improvement in the physical state of the surface described above. A melt viscosity η exceeding $10^6$ (Pa·s) may also cause disadvantageously poor dispersibility in the binder resin.

The weight average molecular weight of the high melt viscosity resin is 300 to 3000, and preferably 500 to 2500, for the purpose of satisfactory compatibility with a binder resin and satisfactory dispersion in a binder resin. A weight average molecular weight less than 300 may cause disadvantage due to difficulty in keeping a solid form at ambient temperature, while that exceeding 3000 may cause disadvantage due to poor mobility of the system.

When the binder resin described above is added internally to a toner according to the present invention, the two resins having different characteristics, namely, a binder resin and a high melt viscosity resin, should preferably have a difference in the SP value of 3 or less, and more preferably 1.5 or less, for the purpose of satisfactory compatibility. The two resins whose difference in SP value exceeds 3 may not be uniformly mixed with each other, resulting in localization of the high melt viscosity resin in the matrix of the binder resin, which may cause disadvantageously insufficient image cohesive force-increasing effect. The SP values are determined by Fedors method.

When added internally, the toner may contain a high melt viscosity resin in an amount of 3 to 50 parts by weight, preferably 5 to 50 parts by weight, and more preferably 10 to 30 parts by weight, based on 100 parts by weight of a binder resin. An amount less than 3 parts by weight may result in disadvantageously insufficient effect of the present invention, while that exceeding 50 parts by weight may also be disadvantageous because of reduced adhesiveness between toner particles.

The number average particle size of a resin microparticle added externally to a toner is preferably 0.05 to 1.0 μm and more preferably 0.05 to 0.5 μm. A number average particle size less than 0.05 μm may causes aggregation of the resin microparticles, which may disadvantageously lead to difficulty in uniform external addition into a mother toner, while that exceeding 1.0 μm may cause release of the externally added resin microparticle from the mother toner, which may also disadvantageously lead to insufficient effect being realized. With regard to the morphology, the resin microparticle according to the present invention may be spherical or amorphous. It is preferably amorphous for the purpose of more stable deposition onto the mother toner.

A resin microparticle is generally added externally to a toner in an amount of 0.3 to 20 parts by weight, preferably 0.3 to 10 parts by weight, based on 100 parts by weight of a mother toner. An amount less than 0.3 parts by weight may result in disadvantageously insufficient effect of the present invention, while that exceeding 20 parts by weight may adversely affect the developability of the toner.

The softening point of a high melt viscosity resin is preferably within the range from 100° C. to 150° C. in view of the stability of a toner and a toner image after fixing and during storage. A softening point of the resin that is sufficiently higher than the ambient temperature during storage or shipping allows the toner and the toner image to be in a stable condition without undergoing adhesion at their surfaces.

The softening point of a resin referred herein is generally a value that is in the middle of the melting initiation temperature and the melting termination temperature, which are determined using a flow tester (SIMADZU Model CFT-500C) with preheating for 300 seconds, at a pressure of 0.980665 MPa, with a die size of 1 mm ϕ×1 mm, at a heating rate of 3.0° C./min.

In preferred embodiments, the high melting viscosity resin exhibits no marked endothermic peak when determined by DSC (differential scanning calorimeter), i.e., exhibits no marked Tg, or exhibits a high Tg. Exhibiting no marked Tg or exhibiting a high Tg means that the high melt viscosity resin is present as a solid in an ordinary storage condition. This presence as a solid may also have an effect on the state of the mixture with a binder resin upon fixing, and, specifically, gives not only an increased cohesive force of the mixed binder resin but also a greatly increased apparent Tg, resulting in further improvement in the image stability during storage.

Although a high melt viscosity resin employed in the present invention may be any of those having the physical properties described above, it is preferably one having an adhering/binding ability that has a low molecular weight and achieves a high melt viscosity. Typically, one ore more substances selected from the group consisting of novolac resins, modified novolac resins, copolymeric petroleum resins of aliphatic hydrocarbons and aromatic hydrocarbons having 9 or more carbon atoms, modified rosins, ester-derivatized modified rosins, terpene resins, phenol resin, modified xylene resins, aliphatic hydrocarbon resin, coumarone-indene resins, styrene resins, aromatic petroleum resin and other C9 petroleum resins may be employed preferably for the purpose of satisfactory compatibility with a binder resin.

The novolac resins and the modified novolac resins described above include phenol novolac resins, cresol novolac resins, alkylbenzene-modified novolac resins, cashew-modified novolac resins, terpene-modified novolac resins and the like.

The copolymeric petroleum resins of aliphatic hydrocarbons and aromatic hydrocarbons having 9 or more carbon atoms employed in the present invention include those synthesized from diolefins and monoolefins contained in a decomposed and distilled oil fraction formed as by-products in an ethylene plant that produces ethylene or propylene by steam cracking of petroleum, and are preferably those obtained by copolymerization of one or more aliphatic hydrocarbon monomers selected from isoprene, piperylene, 2-methyl-butene-2,2-methylbutene-2 with one or more aromatic hydrocarbon monomers selected from vinyltoluene, α-methylstyrene, indene and isopropenyltoluene.

The modified rosins and ester derivatives thereof may be hydrogenated rosins, perhydrogenated rosins, heterogenized rosins, polymerized rosins, glycerylesters of hydrogenated rosins, pentaerythritol esters of polymerized rosins and the like.

The phenol resins include p-alkylphenols, p-allylphenols, p-t-butylphenol as well as terpene-phenol resins.

The modified xylene resins include rosin-modified xylene resins and alkylphenol-modified xylene resins. The polyterpene resins include α-pinene, β-pinene, camphene, dipentene and the like. The aliphatic hydrocarbon resins include straight or branched aliphatic hydrocarbons each having 4 to 9 carbon atoms. The styrene resins include styrene-isoprene copolymers, styrene-butadiene copolymers and styrene-isoprene block copolymers.

The C9 petroleum resin useful in the present invention include resin obtained by using a C9 fraction obtained in a petroleum refining process as a monomer and subjecting it mainly to cation polymerization followed by purification. The C9 fraction monomer used herein may be alkylstyrene, α- and β-methylstyrene, vinyltoluene, indene, naphthalene and the like. Such resins are also commercially available under the trade names of *PETROGINE* from MITSUI PETROLEUM CHEMICAL Co., NEOPOLYMER from NIPPON GOSEI JUSHI Co. and the like.

Among the resins listed above, a copolymeric petroleum resin of a novolac resin, a modified novolac resin, an aliphatic hydrocarbon with an aromatic hydrocarbon having 9 or more carbon atom is preferable because it has satisfactory compatibility with a binder resin and provides a firm structure for the entire image. Particularly preferred is a terpene-modified novolac resin.

Such a terpene-modified novolac resin is a resin obtained by modifying an ordinary novolac resin with a terpene. Such novolac resins include a polynucleus system of a novolac such as the structures of 2-nucleus, 3-nucleus or even more, and also include ortho-ortho binding structures or their isomers. Typically, phenol novolac resins and cresol novolac resins are included.

The terpenes include hemiterpenes, sesquiterpenes, diterpenes, sesterterpenes, triterpenes, tetraterpenes and derivatives thereof (alcohols, aldehydes, ketones, oxides, esters and the like), namely, pinene, dipentene, limonene, paramenthane, pinane, terpene dimer, paramenthadiene, terpeneol, dihydroterpeneol, camphor, myrthenol, cineol, borneol, carbeol, carbon oxide, carbyl acetate, citronellal, citronellol, thymene, dihydrocarbeol, dihydrocarbone, dihydrocarbyl acetate, dihydroterpineol, dihydroterpinyl acetate, isobonyl acetate, linalool, menthol, myrthenol, terpinene, abietic acid, neoabietic acid, levopimaric acid, palustric acid and the like. They may be employed independently or in combination with each other. For the purpose of the firmness of the image after fixing, a terpene having a ring structure is preferably employed. The terpene-modified novolac resin may be in the form of microparticles, chunks, flakes, rods, marbles and the like. When abietic acid is employed as a terpene, the mechanism of synthesis of a terpene-modified novolac resin is as shown below.

Chemical Scheme 1

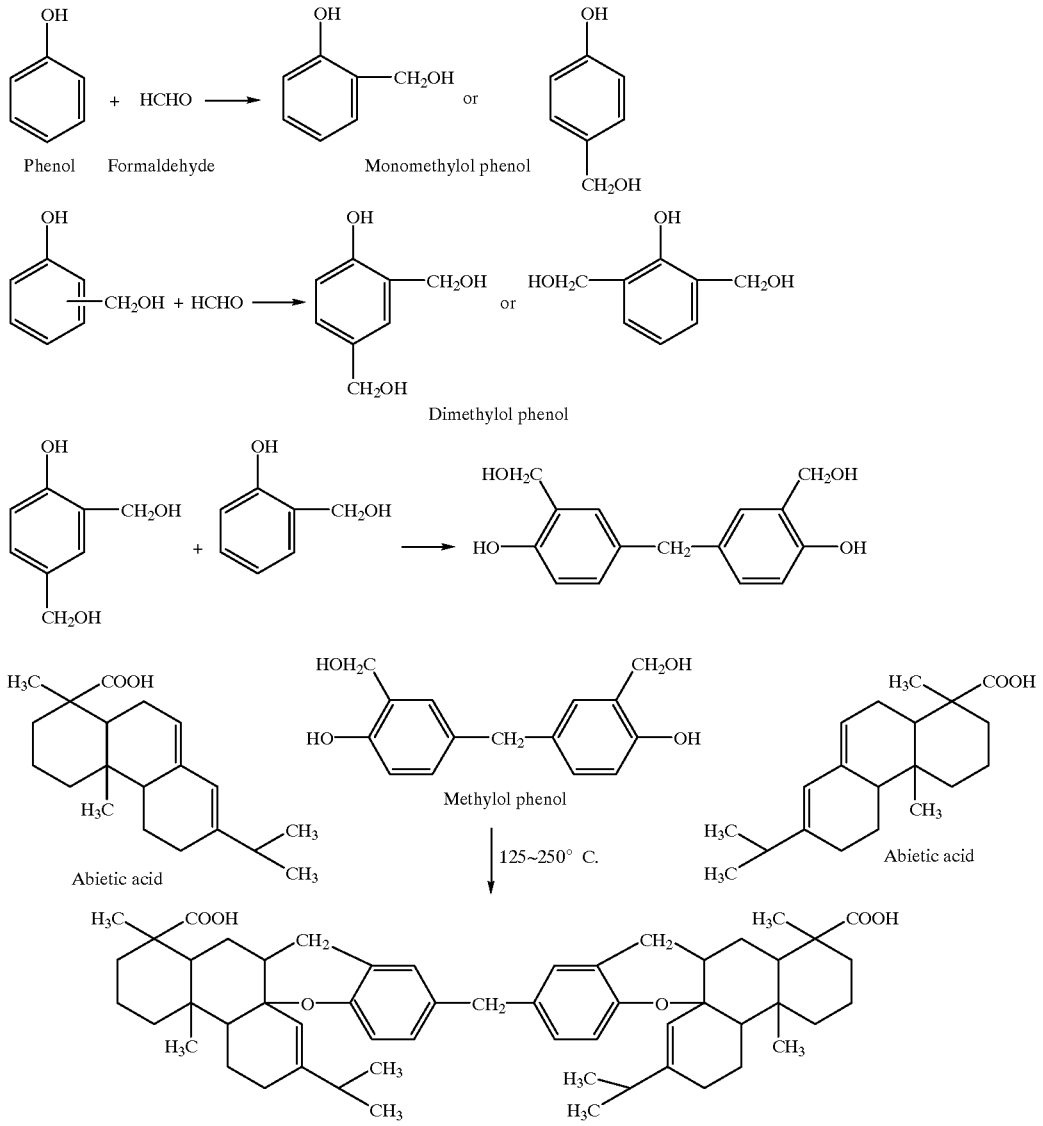

The terpene-modified novolac resin undergoes no gellation during kneading since it undergoes no thermosetting by itself. Accordingly, it does not effect the characteristics naturally associated with a conventional binder resin (low energy fixing, anti-offset ability, toner blocking ability, and producibility).

Other components of a toner for electrophotography according to the present invention are discussed below.

The binder resin described above may be any of known materials useful in a toner for electrophotography. Typical examples are styrenes such as styrene and chlorostyrene, monoolefins such as ethylene, propylene, butylene and isoprene, vinyl esters such as vinyl acetate, vinyl propionate, vinyl benzoate and vinyl butyrate, α-methylene aliphatic monocarboxylates such as methyl acrylate, ethyl acrylate, butyl acrylate, dodecyl acrylate, octyl actylate, phenyl acrylate, methyl methacrylate, ethyl methacrylate, butyl methacrylate and dodecyl methacrylate, vinyl ethers such as vinyl methyl ether, vinyl ethyl ether and vinyl butyl ether, vinyl ketones such as vinyl methyl ketone, vinyl hexyl ketone and vinyl isopropenyl ketone, as well as homopolymers and copolymers thereof. Representative binder resins are polystyrene, styrene-alkyl acrylate copolymers, styerene-alkyl methacrylate copolymers, styrene-acrylonitrile copolymers, styrene-butadiene copolymers, styrene-maleic anhydride copolymers, polyethylene, polypropylene and the like. In addition, polyester, polyurethane, epoxy resins, silicone resins, polyamides, modified rosins and paraffin wax may also be employed. Among those listed above, styrene-alkyl acrylate copolymers and polyester are preferably employed for the purpose of satisfactory charging ability, safety, cost, compatibility with a high melt viscosity resin and the like.

Any of these binder resins has a melt viscosity η at 140° C. less than $10^3$ (Pa·s), preferably 10 to 500 (Pa·s), unlike the high melt viscosity resin described above.

In the present invention, a resin having a low Tg, typically a Tg of 55 to 70° C., can be employed as a binder resin, since a high melt viscosity resin described above contributes to the stability of an image and the binder resin contributes mainly to the fixing ability. Accordingly, improvement in the image stability over a prolonged period can be achieved while preserving satisfactory anti-offset ability and toner blocking characteristics.

A colorant contained as an essential component in a toner according to the present invention may be any of those known as colorants for toners, and specifically includes magnetic particles such as magnetite and ferrite, carbon black, aniline blue, chalcoyl blue, chrome yellow, ultramarine blue, DuPont Oil Red, quinoline yellow, methylene blue chloride, phthalocyanine blue, Malachite Green oxalate, lampblack, rose bengal, C.I. Pigment Red 48:1, C.I. Pigment Red 122, C.I. Pigment Red 57:1, C.I. Pigment Yellow 97, C.I. Pigment Yellow 17, C.I. Pigment Blue 15:1, C.I. Pigment Blue 15:3 and the like.

A toner according to the present invention may also contain a charge controlling agent if desired. Such charge controlling agent may be any of known substances and may be azo-based metal complexes, metal complexes of salicylic acid and a charge controlling agent of a resin type containing a polar group.

A wax such as low molecular weight polypropylenes and low molecular weight polyethylenes may also be added as an anti-offset agent. A toner particle according to the present invention may be employed for both of a magnetic toner enclosing a magnetic material and a non-magnetic toner containing no magnetic material.

A mother toner may be prepared by conventional kneading, pulverizing and classification processes as well as polymerization. It may be amorphous or spherical. Generally, a toner having a volume average particle size of 3 to 10 $\mu$m is preferably employed.

A toner according to the present invention may also contain various additives if necessary. Such additives are inorganic oxide flowability-imparting agents such as silica and titania, cleaning aids or transfer aids such as polystyrene microparticles, polymethyl methacrylate microparticles and polyvinylidene fluoride microparticles. The additives may be admixed into the toner using, for example, a V-shaped blender and a Henschel mixer.

A developer for electrophotography according to the present invention can be employed as a one-component developer or as a two-component developer. A one-component developer generally contains only toner and a two-component developer contains toner and a carrier. A toner employed in a developer according to the present invention characteristically contains a high melt viscosity resin having a weight average molecular weight of 300 to 3000 and a melt viscosity $\eta$ at 140° C. of $10^3$ to $10^6$ (Pa·s).

When a carrier is employed in a two-component developer, the core of the carrier may be made from magnetic metals such as iron, nickel and cobalt, magnetic oxides such as ferrite and magnetite, and glass beads and the like. The core is preferably made from magnetic material when the volume specific resistance is adjusted by the magnetic brush method.

The average particle size of a core is usually 10 to 500 $\mu$m, preferably 30 to 100 $\mu$m. The carrier employed here may be coated with a resin or other material to be charged electrically.

The resins used to coat the carrier include but not limited to polyethylene, polypropylene, polystyrene, polyacrylonitrile, polyvinyl acetate, polyvinyl alcohol, polyvinyl butyral, polyvinyl chloride, polyvinyl carbazol, polyvinyl ether, polyvinyl ketone, vinyl chloride-vinyl acetate copolymer, styrene-acrylic acid copolymer, straight silicone resins having organosiloxane bond or resins modified therefrom, fluoride resins, polyester, polyurethane, polycarbonate, phenol resins, amino resins, melamine resins, benzoguanamine resins, urea resins, amide resins, epoxy resins and the like.

A method for forming a resin coating layer on the surface of a carrier core may, for example, be an immersion method in which a carrier core is immersed in a solution for forming a coating layer that contains a solvent, a spray method in which a solution for forming a coating layer is sprayed onto the surface of a carrier core, a fluidized bed method in which a carrier core is sprayed with a solution for forming a coating layer while being suspended in a flow of air, a kneader coater method in which a carrier core and a solution for forming a coating layer are mixed in a kneader coater and the solvent is separated off.

A developer for electrophotography described above can be employed in an image forming method in which a developer layer on a developer retainer is used to develop an electrostatic latent image on an electrostatic latent image retainer.

A method for forming an image according to the present invention comprises a step in which an electrostatic latent image is formed on a latent image support, a step in which the electrostatic latent image is developed using a developer containing a toner retained on a developer retainer whereby forming a toner image, a step in which the toner image formed on the latent image support is transferred onto a transfer material and a step in which the toner image transferred onto the transfer material is heat-fixed, wherein the toner contains a high melt viscosity resin whose weight average molecular weight is 300 to 3000 and whose melt viscosity $\eta$ at 140° C., is $10^3$ to $10^6$ (Pa·s).

An electrostatic latent image retainer employed herein may be an electrophotographic photoconductor and dielectric recorder and the like. Using the electrostatic latent image retainer, an electrostatic latent image is formed in a known manner. A developer retainer may be one having a magnetic roll fixed in a rotatable non-magnetic sleeve, and the developer retainer is placed facing the electrostatic latent image retainer. A toner image formed on the electrostatic latent image retainer is subsequently transferred onto a transfer material by a known process, preferably using a fixing means employing a heating roll (H/R).

A fixing system employed in a method for forming an image according to the present invention may utilize a heating roll coated with a fluoride-based resin or a heating roll coated with a silicone-based resin. A coating for this heating roll may contain a filler having a high thermal conductivity.

The fixing is conducted preferably at a surface temperature of a heating roll of 150° C. or higher. At such temperature, a binder resin and an adhesiveness-imparting resin are fused with each other sufficiently to exhibit a satisfactory effect of the adhesiveness-imparting resin, whereby forming an intended rigid resin layer having a high melt viscosity on the surface, thus achieving a further higher stability of an image.

An H/R core material employed in a method for forming an image according to the present invention may be Fe, Al, Cu and the like.

Since a method for forming an image according to the present invention provides an image having excellent image stability, which undergoes little or no image blank formation when in contact with another image even under a pressure or even when exposed to a high temperature, it can preferably be employed in an image forming process having a two-sided printing function and a stapler function or a bookbinding function as a post-print finishing step or an image forming process employing a electrophotographic image forming device for office printing in which the functions mentioned above can be installed.

EXAMPLES

The present invention is further described in the following examples, which are not intended to restrict the present invention. In the following description, parts are all parts by weight unless otherwise indicated.

For each of the binder resins and high melt viscosity resins employed to prepare toners below, the parameters determined in the following conditions are indicated.

As used herein, the volume average particle size of the toner is determined using a coulter counter. In addition, the average particle size of the resin microparticles, which is a number average, is determined using a scanning electron microscope (SEM, S-4100 produced by HITACHI Ltd., enlarged to 10,000 power photograph). Using an Image Analyzer (Luzex 3, produced by Nireco), the average particle size of the microparticles is calculated based on 200 particles from the photograph obtained by the SEM.

1. Melt viscosity $\eta$ of resin

A flow tester (SIMADZU Model CFT-500C) is used with pre-heating for 300 seconds, at a pressure of 0.980665 MPa, with a die size of 1 mm $\phi$×1 mm, at a heating rate of 3.0° C./min and at 140° C. (Pa·s).

2. SP value

The SP values are determined by Fedors method.

3. Softening point of resin

The middle of the melting initiation temperature and the melting termination temperature, which are determined using a flow tester (SIMADZU Model CFT-500C) with pre-heating for 300 seconds, at a pressure of 0.980665 MPa, with a die size of 1 mm $\phi$×1 mm and at a heating rate of 3.0° C./min.

EXAMPLE 1

Preparation of toner particle A

| | |
|---|---|
| Binder resin (Bisphenol type polyester resin mainly comprising an ethylene oxide adduct of bisphenol A and terephthalic acid: Weight average molecular weight: $1.1 \times 10^4$, Number average molecular weight: $3.9 \times 10^3$, $\eta$ (140° C.) = 90 Pa · s, Tg: 69° C., SP value: 11.9) | 100 parts |
| High melt viscosity resin (80% polymerized rosin; Weight average molecular weight: 1000, Tm = 139° C., $\eta$ (140° C.) = 2000 Pa · s, SP value: 9.8) | 20 parts |
| Carbon black (BPL; CABOT) | 5 parts |
| Charge controlling agent (*BONTRON P51*; ORIENT KAGAKU) | 2 parts |
| Low molecular weight polypropylene (Viscol 660 P; SANYO KASEI KOGYO, SP value: 8) | 5 parts |

The components shown above are kneaded using a Banbury mixer, cooled, finely divided using a jet mill, and then classified using a classifying machine to obtain toner particles whose volume average particle size is 6 $\mu$m. 100 Parts of these toner particles are admixed, using a Henschel mixer, with 1.0 parts of $TiO_2$, which has been imparted with hydrophobicity using an alkylsilane, to prepare a toner.

EXAMPLE 2

Preparation of toner particle B

| | |
|---|---|
| Binder resin (Bisphenol type polyester resin mainly comprising an ethylene oxide adduct of bisphenol A and terephthalic acid: Weight average molecular weight: $1.5 \times 10^4$, Number average molecular weight: $3.0 \times 10^3$, $\eta$ (140° C.) = 95 Pa · s, Tg: 65° C., SP value: 12.0) | 100 parts |
| High melt viscosity resin (Pentaerythritol-esterified rosin; Weight average molecular weight: 2800, Tm = 105° C., $\eta$ (140° C.) = 2100 Pa · s, SP value: 11.0) | 20 parts |
| Carbon black (BPL; CABOT) | 5 parts |
| Charge controlling agent (*BONTRON P51*; ORIENT KAGAKU) | 2 parts |
| Low molecular weight polypropylene (Viscol 660 P; SANYO KASEI KOGYO, SP value: 8) | 5 parts |

The components shown above are kneaded using a Banbury mixer, cooled, finely divided using a jet mill, and then classified using a classifying machine to obtain toner particles whose volume average particle size is 6 $\mu$m. 100 Parts of these toner particles are admixed, using a Henschel mixer, with 1.0 parts of $TiO_2$, which has been imparted with hydrophobicity using an alkylsilane, to prepare a toner.

EXAMPLE 3

Preparation of toner particle C

| | |
|---|---|
| Binder resin (St/nBA copolymer resin: Copolymerization ratio: 75:25, Weight average molecular weight: $1.2 \times 10^5$, Number average molecular weight: $2.2 \times 10^4$, $\eta$ (140° C.) = 450 Pa · s, Tg: 63° C., SP value: 10.1) | 100 parts |
| High melt viscosity resin (Isoprene-piperylene-isopropenyltoluene copolymer resin: Copolymerization ratio: 1.5:1.5:97; Weight average molecular weight: 1940, Tm = 125° C., $\eta$ (140° C.) = 8000 Pa · s, SP value: 9.9) | 20 parts |
| Carbon black (BPL; CABOT) | 5 parts |
| Charge controlling agent (*BONTRON P51*; ORIENT KAGAKU) | 2 parts |
| Low molecular weight polypropylene (Viscol 660 P; SANYO KASEI KOGYO, SP value: 8) | 5 parts |

The components shown above are kneaded using a Banbury mixer, cooled, finely divided using a jet mill, and then classified using a classifying machine to obtain toner particles whose volume average particle size is 6 $\mu$m. 100 Parts of these toner particles are admixed, using a Henschel mixer, with 1.0 parts of $TiO_2$, which has been imparted with hydrophobicity using an alkylsilane, to prepare a toner.

EXAMPLE 4

Preparation of toner particle D

| | |
|---|---|
| Binder resin (Bisphenol type polyester resin mainly comprising an ethylene oxide adduct of bisphenol A and terephthalic acid: Weight average molecular weight: $1.1 \times 10^4$, Number average molecular weight: $3.9 \times 10^3$, $\eta$ (140° C.) = 90 Pa · s, Tg: 69° C., SP value: 11.9) | 100 parts |
| High melt viscosity resin ($\beta$-pinene-based terpene resin; Weight average molecular weight: 2500, Tm = 104° C., $\eta$ (140° C.) = 8000 Pa · s, SP value: 8.9) | 20 parts |
| Carbon black (BPL; CABOT) | 5 parts |
| Charge controlling agent (*BONTRON P51*; ORIENT KAGAKU) | 2 parts |

-continued

| | |
|---|---|
| Low molecular weight polypropylene (Viscol 660 P; SANYO KASEI KOGYO, SP value: 8) | 5 parts |

The components shown above are kneaded using a Banbury mixer, cooled, finely divided using a jet mill, and then classified using a classifying machine to obtain toner particles whose volume average particle size is 6 $\mu$m. 100 Parts of these toner particles are admixed, using a Henschel mixer, with 1.0 parts of $TiO_2$, which has been imparted with hydrophobicity using an alkylsilane, to prepare a toner.

EXAMPLE 5

Preparation of toner particle E

Preparation is carried out the same as in Example 1 except for using 3 parts of the high melt viscosity resin.

EXAMPLE 6

Preparation of toner particle F

Preparation is carried out the same as in Example 1 except for using 55 parts of the high melt viscosity resin.

COMPARATIVE EXAMPLE 1

Preparation of toner particle G

| | |
|---|---|
| Binder resin (St/nBA copolymer resin: Copolymerization ratio: 75:25, Weight average molecular weight: $1.2 \times 10^5$, Number average molecular weight: $2.2 \times 10^4$, $\eta$ (140° C.) = 450 Pa · s, Tg: 63° C., SP value: 10.1) | 100 parts |
| High melt viscosity resin (Indene-isopropenyltoluene copolymer resin: Copolymerization ratio: 50:50; Weight average molecular weight: 5000, Tm = 150° C., $\eta$ (140° C.) = 130000 Pa · s, SP value: 9.8) | 20 parts |
| Carbon black (BPL; CABOT) | 5 parts |
| Charge controlling agent (*BONTRON P51*; ORIENT KAGAKU) | 2 parts |
| Low molecular weight polypropylene (Viscol 660 P; SANYO KASEI KOGYO, SP value: 8) | 5 parts |

The components shown above are kneaded using a Banbury mixer, cooled, finely divided using a jet mill, and then classified using a classifying machine to obtain toner particles whose volume average particle size is 6 $\mu$m. 100 Parts of these toner particles are admixed, using a Henschel mixer, with 1.0 parts of $TiO_2$, which has been imparted with hydrophobicity using an alkylsilane, to prepare a toner.

COMPARATIVE EXAMPLE 2

Preparation of toner particle H

| | |
|---|---|
| Binder resin (Bisphenol type polyester resin mainly comprising an ethylene oxide adduct of bisphenol A and terephthalic acid: Weight average molecular weight: $1.1 \times 10^4$, Number average molecular weight: $3.9 \times 10^3$, Tg: 69° C., $\eta$ (140° C.) = 90 Pa · s, SP value: 11.9) | 100 parts |
| High melt viscosity resin ($\alpha$-pinene-based terpene resin; Weight average molecular weight: 4000, Tm = 84° C., $\eta$ (140° C.) = 15000 Pa · s, SP value: 8.8) | 20 parts |
| Carbon black (BPL; CABOT) | 5 parts |
| Charge controlling agent (*BONTRON P51*; ORIENT KAGAKU) | 2 parts |
| Low molecular weight polypropylene (Viscol 660 P; SANYO KASEI KOGYO, SP value: 8) | 5 parts |

The components shown above are kneaded using a Banbury mixer, cooled, finely divided using a jet mill, and then classified using a classifying machine to obtain toner particles whose volume average particle size is 6 $\mu$m. 100 Parts of these toner particles are admixed, using a Henschel mixer, with 1.0 parts of $TiO_2$, which has been imparted with hydrophobicity using an alkylsilane, to prepare a toner.

[Preparation of two-component developer for electrophotography]

(Carrier preparation)

| | |
|---|---|
| Ferrite particles (average particle size: 50 $\mu$m) | 100 parts |
| Toluene | 14 parts |
| Styrene methylmethacrylate copolymer | 1 part |
| Polymethyl methacrylate | 1 part |

The components listed above except for the ferrite particles are stirred for 10 minutes using a stirrer, to prepare a coating solution. The coating solution is then placed together with the ferrite particles into a vacuum degassing kneader to mix for 30 minutes at 60° C. and then further heated under reduced pressure to effect degassing and drying to obtain carrier A.

(Developer preparation)

5 Parts of each of toners A to G described above and 100 parts of carrier A obtained above are mixed and stirred for 20 minutes at 40 rpm using a V-shaped blender to prepare a developer.

[Evaluation of developer]

The two-component developer described above is subjected to the image sampling test using a modified XC Docu-Tech Model 135 (fixing heat roll: the Al core ($\phi$100) coated with PFA containing 5% SiC to a thickness of 40 $\mu$m, a pressure roll: the iron core ($\phi$100) coated with SR to a thickness of 5 mm, modified to obtain a nip pressure of 1.5 kgf/cm$^2$ and to control the heating temperature at 150° C., 180° C. and 200° C.).

Subsequently, the following performance tests are conducted.

(1) Toner heat storage performance

At 50° C., each toner is placed in a container for 24 hours, and then 20 g of the toner is mounted on a 45 $\mu$m mesh screen, which is oscillated for 90 seconds during which the toner was allowed to pass. The % amount of toner remaining on the screen based on the amount of the entire toner is determined.

(2) Fixing characteristics

At a process speed of 550 mm/sec., the temperature is raised stepwise from 120° C. to 200° C., and at each step the amount of the toner contained in the developer is varied to vary the toner thickness stepwise from 8 to 12 $\mu$m. Then the toner is fixed in each condition to obtain a fixed image, which is evaluated for the strength of the fixed image. The strength of the fixed image is determined by folding a 40 mm×50 mm solid toner fixed image using a load having a certain weight followed by evaluating the image blank of the folded part according to the criteria shown below.

[Evaluation criteria]

G5: Completely no blank in image in folded part (○).

G4: Acceptable level with lines remaining in folded part but no blank in image (○).

G3: Several white lines observed in folded part and some blanks in image (Δ).

G2: Blanks in image also in areas other than folded part (X).

G1: Insufficient fixation and blanks occurring just upon contact (X).

(3) Image keeping capability

On the surface of each of two papers, solid images and line images are formed in a certain layout. Then the two papers are overlaid with one imaged surfaces facing the other to obtain the image overlaying patterns listed below, which are then kept for a period of 1 week to 1 month under a load of 100 g/cm$^2$ at 65° C. Then the state of the blanks formed in the image is evaluated according to the criteria shown below.

[Overlaying pattern]

1) Solid image×Solid image
2) Solid image×line image
3) Line image×Line image
4) Solid image×Non-imaged area
5) Line image×Non-imaged area

[Evaluation criteria]

G5: No inter-image adhesion and no blank formation (○).
G4: Inter-image adhesion without blank formation (○).
G3: Blanks in part of line image (Δ).
G2: Marked blanks especially in solid image (X).
G1: Marked blanks in both of solid image and line image (X).

The results of the evaluation are indicated in Table 1 shown below.

-continued

| | |
|---|---|
| molecular weight: 3.9 × 10$^3$, η (140° C.) = 90 Pa · s, Tg: 69° C., SP value: 11.9) | |
| High melt viscosity resin (Abietic acid-modified novolac resin; Weight average molecular weight: 1100, Number average molecular weight: 900, Softening point: 135° C., η (140° C.) = 60000 Pa · s, SP value: 10.2) | 20 parts |
| Carbon black (BPL; CABOT) | 5 parts |
| Charge controlling agent (*BONTRON P51*; ORIENT KAGAKU) | 2 parts |
| Low molecular weight polypropylene (Viscol 660 P: SANYO KASEI KOGYO, SP value: 8) | 5 parts |

The components shown above are kneaded using a Banbury mixer, cooled, finely divided using a jet mill, and then classified using a classifying machine to obtain toner particles whose volume average particle size is 6 μm. 100 Parts of these toner particles are admixed, using a Henschel mixer, with 1.0 parts of $TiO_2$, which has been imparted with hydrophobicity using an alkylsilane, to prepare a toner.

TABLE 1

| | High melt viscosity resin | | | Image Keeping Capability (65° C., 100 g/cm$^2$ load) | | | | | | | | |
|---|---|---|---|---|---|---|---|---|---|---|---|---|
| | Melt | Difference in SP | | Fixing temperature 150° C. | | | Fixing temperature 180° C. | | | Fixing temperature 200° C. | | |
| | Viscosity | value from binder resin | ① | ② | ③ | ④ | ② | ③ | ④ | ② | ③ | ④ |
| Example 1 | 2000 | 2.1 | 3% | G3(Δ) | G3(Δ) | G3(Δ) | G4(○) | G4(○) | G4(○) | G5(○) | G5(○) | G5(○) |
| Example 2 | 2100 | 1.0 | 9% | G4(○) | G4(○) | G3(Δ) | G5(○) | G5(○) | G4(○) | G5(○) | G5(○) | G5(○) |
| Example 3 | 8000 | 0.2 | 6% | G4(○) | G4(○) | G3(Δ) | G5(○) | G4(○) | G4(○) | G5(○) | G5(○) | G4(○) |
| Example 4 | 8000 | 3.0 | 5% | G4(○) | G3(Δ) | G3(Δ) | G5(○) | G5(○) | G3(Δ) | G5(○) | G5(○) | G4(○) |
| Example 5 | 2000*1 | 2.1 | 11% | G4(○) | G3(Δ) | G2(X) | G5(○) | G4(○) | G3(Δ) | G5(○) | G3(Δ) | G3(Δ) |
| Example 6 | 2000*1 | 2.1 | 3% | G3(Δ) | G3(Δ) | G2(X) | G4(○) | G3(Δ) | G3(Δ) | G4(○) | G3(Δ) | G3(Δ) |
| Comparative Example 1 | 130,000 | 0.3 | 6% | G3(Δ) | G2(X) | G1(X) | G3(Δ) | G2(X) | G1(X) | G5(○) | G3(Δ) | G2(X) |
| Comparative Example 2 | 15,000 | 3.1 | 9% | G4(○) | G1(X) | G1(X) | G5(○) | G2(X) | G1(X) | G5(○) | G3(Δ) | G1(X) |

① Toner heat storage performance
② Fixing Characteristics
③ After 1 week
④ After 1 month
*1Same resin as in Example 1, but at a difference content As evident from Table 1, an image formed using a toner according to the present invention as a developer exhibits satisfactory fixing ability as well as excellent image stability when stored for a prolonged period at a high temperature. In addition, comparing Example 1 with Example 5 or 6 reveals that more excellent effects are observed when a high melt viscosity resin is contained in an amount of 5 to 50 parts by weight based on 100 parts by weight binder resin. On the other hand, Comparative Example 1 employing a resin that has a high melt viscosity but has a large molecular weight and Comparative Example 2 whose SP value of the binder resin differed from that of the high melt viscosity resin by 3 or more involved problems with regard to the image keeping ability.

EXAMPLE 7

Preparation of toner particle I (Black)

| | |
|---|---|
| Binder resin (Bisphenol type polyester resin mainly comprising an ethylene oxide adduct of bisphenol A and terephthalic acid: Weight average molecular weight: 1.1 × 10$^4$, Number average | 100 parts |

EXAMPLE 8

Preparation of toner particle J (Black)

| | |
|---|---|
| Binder resin (St/nBA copolymer resin: Copolymerization ratio: 75:25, Weight average molecular weight: 1.2 × 10$^5$, Number average molecular weight: 2.2 × 10$^4$, Tg: 63° C., η (140° C.) = 450 Pa · s, SP value: 10.1) | 80 parts |
| High melt viscosity resin (Isoprene-piperylene-isopropenyltoluene copolymer resin: Copolymerization ratio: 1.5:1.5:97; Weight average molecular weight: 2000, Softening point: 121° C., η (140° C.) = 10000 Pa · s, SP value: 9.9) | 20 parts |
| Carbon black (BPL; CABOT) | 5 parts |
| Charge controlling agent (*BONTRON P51*; ORIENT KAGAKU) | 2 parts |
| Low molecular weight polypropylene (Viscol 660 P; SANYO KASEI KOGYO) | 5 parts |

The components shown above are kneaded using a Banbury mixer, cooled, finely divided using a jet mill, and then classified using a classifying machine to obtain toner particles whose volume average particle size is 6 μm. 100 Parts of these toner particles are admixed, using a Henschel mixer, with 1.0 parts of $TiO_2$, which has been imparted with hydrophobicity using an alkylsilane, to prepare a toner.

EXAMPLE 9

Preparation of toner particle K (Black)

| | |
|---|---|
| Binder resin (Bisphenol type polyester resin mainly comprising an ethylene oxide adduct of bisphenol A and terephthalic acid: Weight average molecular weight: $1.1 \times 10^4$, Number average molecular weight: $3.9 \times 10^3$, Tg: 69° C., η (140° C.) = 90 Pa · s, SP value: 11.9) | 80 parts |
| High melt viscosity resin (m-Cresol novolac resin; Weight average molecular weight: 3000, Number average molecular weight: 750, Softening point: 122° C., η (140° C.) = 70000 Pa · s, SP value: 9.0) | 20 parts |
| Carbon black (BPL; CABOT) | 5 parts |
| Charge controlling agent (*BONTRON P51*; ORIENT KAGAKU) | 2 parts |
| Low molecular weight polypropylene (Viscol 660 P; SANYO KASEI KOGYO) | 5 parts |

The components shown above are kneaded using a Banbury mixer, cooled, finely divided using a jet mill, and then classified using a classifying machine to obtain toner particles whose volume average particle size is 6 μm. 100 Parts of these toner particles are admixed, using a Henschel mixer, with 1.0 parts of $TiO_2$, which has been imparted with hydrophobicity using an alkylsilane, to prepare a toner.

EXAMPLE 10

Preparation of toner particle M (Black)

Preparation is carried out the same as in Example 7 except for using 3% of the high melt viscosity resin.

EXAMPLE 11

Preparation of toner particle (Black)

Preparation is carried out the same as in Example 7 except for using 55% of the high melt viscosity resin.

COMPARATIVE EXAMPLE 3

Preparation of toner particle N (Black)

| | |
|---|---|
| Binder resin (Bisphenol type polyester resin mainly comprising an ethylene oxide adduct of bisphenol A and terephthalic acid: Weight average molecular weight: $1.1 \times 10^4$, Number average molecular weight: $3.9 \times 10^4$, Tg: 69° C., η (140° C.) = 90 Pa · s, SP value: 11.9) | 80 parts |
| High melt viscosity resin (Bisphenol A type epoxy resin; Weight average molecular weight: $2.5 \times 10^4$, Number average molecular weight: $6.3 \times 10^3$, Softening point: 118° C., η (140° C.) = 2000 Pa · s, SP value: 10.3) | 20 parts |
| Carbon black (BPL; CABOT) | 5 parts |
| Charge controlling agent (*BONTRON P51*; ORIENT KAGAKU) | 2 parts |
| Low molecular weight polypropylene (Viscol 660 P; SANYO KASEI KOGYO) | 5 parts |

The components shown above are kneaded using a Banbury mixer, cooled, finely divided using a jet mill, and then classified using a classifying machine to obtain toner particles whose volume average particle size is 6 μm. 100 Parts of these toner particles are admixed, using a Henschel mixer, with 1.0 parts of $TiO_2$, which has been imparted with hydrophobicity using an alkylsilane, to prepare a toner.

COMPARATIVE EXAMPLE 4

Preparation of toner particle O (Black)

| | |
|---|---|
| Binder resin (St/nBA copolymer resin: Copolymerization ratio: 75:25, Weight average molecular weight: $1.2 \times 10^5$, Number average molecular weight: $2.2 \times 10^4$, Tg: 63° C., η (140° C.) = 450 Pa · s, SP value: 10.1) | 80 parts |
| High melt viscosity resin (Indene-isopropenyltoluene copolymer resin: Copolymerization ratio: 50:50; Weight average molecular weight: 5000, Number average molecular weight: 1200, Softening point: 150° C., η (140° C.) = 1500000 Pa · s, SP value: 9.9) | 20 parts |
| Carbon black (BPL; CABOT) | 5 parts |
| Charge controlling agent (*BONTRON P51*; ORIENT KAGAKU) | 2 parts |
| Low molecular weight polypropylene (Viscol 660 P; SANYO KASEI KOGYO) | 5 parts |

The components shown above are kneaded using a Banbury mixer, cooled, finely divided using a jet mill, and then classified using a classifying machine to obtain toner particles whose volume average particle size is 6 μm. 100 Parts of these toner particles are admixed, using a Henschel mixer, with 1.0 parts of $TiO_2$, which has been imparted with hydrophobicity using an alkylsilane, to prepare a toner.

[Preparation of two-component developer for electrophotography]

5 Parts of each of toners 1 to 0 described above and 100 parts of resin coating carrier A employed in Examples 1 to 6 are mixed and stirred for 20 minutes at 40 rpm using a V-shaped blender to prepare a developer.

Using the two-component developers of Examples 7 to 12 and Comparative Examples 3 to 4 thus obtained, the images are formed as in Examples 1 to 6 and similarly examined for performance with regard to (1) Toner heat storage performance, (2) Fixing characteristics, and (3) Image keeping capability. The results are indicated in Table 2 shown below.

TABLE 2

| | High melt viscosity resin | | | Image Keeping Capability (65° C., 100 g/cm² load) | | | | | | | | |
|---|---|---|---|---|---|---|---|---|---|---|---|---|
| | Melt | Difference in SP | | Fixing temperature 150° C. | | | Fixing temperature 180° C. | | | Fixing temperature 200° C. | | |
| | Viscosity | value from binder resin | ① | ② | ③ | ④ | ② | ③ | ④ | ② | ③ | ④ |
| Example 7 | 60,000 | 1.7 | 10% | G4(○) | G4(○) | G3(Δ) | G5(○) | G5(○) | G4(○) | G5(○) | G5(○) | G5(○) |
| Example 8 | 10,000 | 0.2 | 9% | G4(○) | G3(Δ) | G3(Δ) | G5(○) | G5(○) | G4(○) | G5(○) | G5(○) | G5(○) |
| Example 9 | 70,000 | 2.9 | 11% | G4(○) | G4(○) | G3(Δ) | G5(○) | G4(○) | G4(○) | G5(○) | G5(○) | G4(○) |
| Example 10 | 60,000*2 | 1.7 | 5% | G4(○) | G3(Δ) | G2(X) | G5(○) | G4(○) | G3(Δ) | G5(○) | G3(Δ) | G3(Δ) |
| Example 11 | 60,000*2 | 1.7 | 3% | G4(○) | G3(Δ) | G2(X) | G4(○) | G3(Δ) | G2(X) | G4(○) | G4(○) | G3(Δ) |

TABLE 2-continued

| | High melt viscosity resin | | | Image Keeping Capability (65° C., 100 g/cm$^2$ load) | | | | | | | | |
|---|---|---|---|---|---|---|---|---|---|---|---|---|
| | Melt | Difference in SP | | Fixing temperature 150° C. | | | Fixing temperature 180° C. | | | Fixing temperature 200° C. | | |
| | Viscosity | value from binder resin | ① | ② | ③ | ④ | ② | ③ | ④ | ② | ③ | ④ |
| Comparative Example 3 | 2,000 | 1.6 | 3% | G3(Δ) | G2(X) | G1(X) | G4(○) | G2(X) | G1(X) | G5(○) | G3(Δ) | G2(X) |
| Comparative Example 4 | 1,500,000 | 0.2 | 8% | G4(○) | G1(X) | G1(X) | G5(○) | G2(X) | G1(X) | G5(○) | G3(Δ) | G1(X) |

① Toner heat storage performance
② Fixing Characteristics
③ After 1 week
④ After 1 month
*2Same resin as in Example 7, but at a different content As evident from Table 2, by using a developer for electrophotography that contains a toner of the present invention, a high image keeping capability is achieved even under pressure and at a high temperature without affecting the toner heat storage performance or the fixing characteristics adversely. In addition, comparing Example 7 with Example 10 or 11 reveals that a more excellent effect is observed when a high melt viscosity resin is contained in an amount of 5 to 50 parts by weight based on 100 parts by weight of binder resin. On the other hand, the results of Comparative Example 3 indicate that a resin having a large molecular weight may cause problems with regard to fixing characteristics and the image keeping ability, even when it has a high melt viscosity.

[Examples and Comparative Examples of External Addition]

Preparation of mother toner P

| | |
|---|---|
| Binder resin<br>(Bisphenol type polyester resin mainly comprising an ethylene oxide adduct of bisphenol A and terephthalic acid)<br><Weight average molecular weight: 1.1 × $10^4$, Number average molecular weight: 4.7 × $10^3$, η (140° C.) = 90 Pa · s, Tg: 65° C., SP value: 11.6> | 100 parts |
| Carbon black (BPL) | 5 parts |
| Charge controlling agent (*BONTRON E84*) | 2 parts |
| Low molecular weight polypropylene (Viscol 660 P) | 5 parts |

The components shown above are kneaded using a Banbury mixer, cooled, finely divided using a jet mill, and then classified using a classifying machine to obtain toner particles whose volume average particle size is 6 μm.

Preparation of mother toner Q

| | |
|---|---|
| Binder resin<br>(St/nBA copolymer resin; Copolymerization ratio 75:25)<br><Low molecular weight component/Weight average molecular weight: 5.5 × $10^3$, Number average molecular weight: 2.5 × $10^3$, Tg: 60° C.><br><High molecular weight component/Weight average molecular weight: 6.0 × $10^5$, Number average molecular weight: 3.0 × $10^5$, Tg: 60° C.><br><High molecular weight/low molecular weight = 30/70><br><Total: Weight average molecular weight: 2.0 × $10^5$, Number average molecular weight: 3.6 × $10^3$, η (140° C.) = 450 Pa · s, Tg: 63° C., SP value: 10.1> | 100 parts |
| Carbon black (BPL) | 5 parts |
| Charge controlling agent (*BONTRON E84*) | 2 parts |
| Low molecular weight polypropylene (Viscol 660 P) | 5 parts |

The components shown above are kneaded using a Banbury mixer, cooled, finely divided using a jet mill, and then classified using a classifying machine to obtain toner particles whose volume average particle size is 6 μm.

Preparation of resin microparticle A

A solution of 10 g of 80% polymerized rosin (weight average molecular weight: 1000, Softening point=139° C., η (140° C.)=2000 Pa·s, SP value: 9.8) dissolved in 300 ml of acetone is added dropwise to 3000 g of distilled water, and after completion of the addition the mixture is stirred continuously for an additional 30 minutes to precipitate a resin. The resin thus precipitated is filtered under reduced pressure and the residue is dried in an oven drier, pulverized, and coarse particles are sieved off to obtain a resin microparticle whose average particle size is 0.3 μm.

Preparation of resin microparticle B

Isoprene-piperylene-isopropenyltoluene copolymer resin (copolymerization ratio: 1.5:1.5:97, weight average molecular weight: 1940, Softening point=125° C., η(140° C.)=8000 Pa·s, SP value: 9.9) is processed the same as resin microparticle A to obtain a resin microparticle whose average particle size is 0.2 μm.

Preparation of resin microparticle C

Indene-isopropenyltoluene copolymer resin (copolymerization ratio: 50:50, weight average molecular weight: 5000, Softening point=155° C., η (140° C.)=130000 Pa·s, SP value: 9.8) is processed the same as resin microparticle A to obtain a resin microparticle whose average particle size is 0.25 μm.

Preparation of resin microparticle D

Isoprene-piperylene-isopropenyltoluene copolymer resin (copolymerization ratio: 1.5:1.5:97, weight average molecular weight: 4000, Softening point=125° C., η(140° C.)=8000 Pa·s, SP value: 9.9) is processed the same as resin microparticle A to obtain a resin microparticle whose average particle size is 1.5 μm.

Preparation of resin microparticle E

A solution of 100 g of polymerized P-pinene-based terpene resin (weight average molecular weight: 2500, Softening point=104° C., η(140° C.)=6000 Pa·s, SP value: 8.4) dissolved in 300 ml of acetone is added dropwise to 3000 g of distilled water, and after completion of the addition the mixture is stirred continuously for an additional 30 minutes to precipitate resin. The resin thus precipitated is filtered under reduced pressure and the residue is dried in an oven drier, pulverized, and coarse particles are sieved off to obtain a resin microparticle whose average particle size is 0.3 μm.

EXAMPLE 12

Preparation of externally added toner A

100 Parts by weight of a mother toner particle P is admixed, using a Henschel mixer, with 1.0 parts of $TiO_2$, which has been imparted with hydrophobicity using an alkylsilane, and 1.0 parts of resin microparticle A to prepare an externally added toner.

EXAMPLE 13

Preparation of externally added toner B

100 Parts by weight of a mother toner particle Q is admixed, using a Henschel mixer, with 1.0 parts of $TiO_2$, which has been imparted with hydrophobicity using an alkylsilane, and 1.0 parts of resin microparticle A to prepare an externally added toner.

EXAMPLE 14

Preparation of externally added toner C

100 Parts by weight of a mother toner particle Q is admixed, using a Henschel mixer, with 1.0 parts of $TiO_2$, which has been imparted with hydrophobicity using an alkylsilane, and 1.0 parts of resin microparticle B to prepare an externally added toner.

EXAMPLE 15

Preparation of externally added toner D

100 Parts by weight of a mother toner particle P is admixed, using a Henschel mixer, with 1.0 parts of $TiO_2$, which has been imparted with hydrophobicity using an alkylsilane, and 0.2 parts of resin microparticle A to prepare an externally added toner.

EXAMPLE 16

Preparation of externally added toner E

100 Parts by weight of a mother toner particle P is admixed, using a Henschel mixer, with 1.0 parts of $TiO_2$, which has been imparted with hydrophobicity using an alkylsilane, and 1.5 parts of resin microparticle A to prepare an externally added toner.

EXAMPLE 17

Preparation of externally added toner F

100 Parts by weight of a mother toner particle P is admixed, using a Henschel mixer, with 1.0 parts of $TiO_2$, which has been imparted with hydrophobicity using an alkysilane, and 1.0 parts of resin microcparticle E to prepare an externally added toner.

COMPARATIVE EXAMPLE 5

Preparation of externally added toner G

100 Parts by weight of a mother toner particle P is admixed, using a Henschel mixer, with 1.0 parts of $TiO_2$, which has been imparted with hydrophobicity using an alkylsilane, and 1.0 parts of resin microparticle C to prepare an externally added toner.

COMPARATIVE EXAMPLE 6

Preparation of externally added toner H

100 Parts by weight of a mother toner particle P is admixed, using a Henschel mixer, with 1.0 parts of $TiO_2$, which has been imparted with hydrophobicity using an alkylsilane, and 1.0 parts of resin microparticle D to prepare an externally added toner.

[Preparation of two-component developer for electrophotography]

(Preparation of developer)

5 Parts of each of externally added toners A to H described above and 100 parts of carrier A employed in Examples 1 are mixed and stirred for 20 minutes at 40 rpm using a V-shaped blender to prepare a developer.

(Evaluation of developer)

The two-component developers thus obtained are evaluated as in Example 1. The results are indicated in Table 3 shown below.

TABLE 3

| | Amount Added | | Fixing temperatures 150° C. | | | Fixing temperatures 180° C. | | | Fixing temperatures 200° C. | | |
|---|---|---|---|---|---|---|---|---|---|---|---|
| | Externally | ① | ② | ③ | ④ | ② | ③ | ④ | ② | ③ | ④ |
| Example 12 | 1.0% | 4% | G4 | G4 | G3 | G5 | G5 | G4 | G5 | G5 | G5 |
| Example 13 | 1.0% | 3% | G3 | G3 | G3 | G4 | G4 | G4 | G5 | G5 | G5 |
| Example 14 | 5.0% | 5% | G3 | G3 | G3 | G4 | G4 | G3 | G5 | G5 | G4 |
| Example 15 | 0.2% | 7% | G4 | G4 | G2 | G5 | G3 | G2 | G5 | G4 | G2 |
| Example 16 | 15% | 2% | G4 | G3 | G2 | G5 | G3 | G2 | G5 | G4 | G2 |
| Example 17 | 1.0% | 5% | G4 | G3 | G3 | G5 | G3 | G3 | G5 | G4 | G3 |
| Comparative Example 5 | 1.0% | 5% | G4 | G2 | G1 | G5 | G2 | G1 | G5 | G3 | G1 |
| Comparative Example 6 | 1.0% | 6% | G4 | G1 | G1 | G5 | G3 | G1 | G5 | G3 | G1 |

① Toner heat storage performance
② Fixing Characteristics
③ After 1 week
④ After 1 month As evident from Table 3, an image formed using a toner according to the present invention as a developer exhibits satisfactory fixing ability as well as excellent image stability when stored for a prolonged period at a high temperature. In addition, comparing Example 12 with Example 15 or 16 reveals that a more excellent effect is observed when a resin microparticle externally added is contained in an amount of 0.3 to 10 parts by weight based on 100 parts by weight of a mother toner. On the other hand, Comparative Example 5 employing a resin microparticle having a large molecular weight and a high melt viscosity and Comparative Example 6 employing a large size microparticle involve problems with regard to the image keeping ability.

[Examples of use of terpene-modified novolac resin]

EXAMPLE 18

Preparation of toner particle (Black)

| | |
|---|---|
| Binder resin (Bisphenol type polyester resin mainly comprising an ethylene oxide adduct of bisphenol A and terephthalic acid: Weight average molecular weight: $9.6 \times 10^5$, Number average molecular weight: $4.7 \times 10^3$, Tg: 65° C., η (140° C.) = 130 (Pa · s), SP value: 11.9) | 100 parts |
| Carbon black (BPL; CABOT) | 5 parts |
| Charge controlling agent (*BONTRON E84*; ORIENT KAGAKU) | 2 parts |
| Low molecular weight polypropylene (Viscol 660 P; SANYO KASEI KOGYO) | 5 parts |
| Terpene-modified novolac resin (η (140° C.) = 60000 (Pa · s), SP value: 10.2, Weight average molecular weight: 1100, Softening point: 140° C., PR-12603; SUMITOMO *DURES*) | 2 parts |

The components shown above are kneaded using a Banbury mixer, cooled, finely divided using a jet mill, and then classified using a classifying machine to obtain toner particles whose volume average particle size is 6 μm. 100 Parts of these toner particles are admixed, using a Henschel mixer, with 1.0 parts of $TiO_2$, which has been imparted with hydrophobicity using an alkylsilane, to prepare a toner.

EXAMPLE 19

A toner is prepared in the same manner as that in Example 18 except for using 3 parts of the terpene-modified novolac resin.

EXAMPLE 20

A toner is prepared in the same manner as that in Example 18 except for using 5 parts of the terpene-modified novolac resin.

EXAMPLE 21

A toner is prepared in the same manner as that in Example 18 except for using 20 parts of the terpene-modified novolac resin.

EXAMPLE 22

A toner is prepared in the same manner as that in Example 18 except for using 30 parts of the terpene-modified novolac resin.

EXAMPLE 23

A toner is prepared in the same manner as that in Example 18 except for using 50 parts of the terpene-modified novolac resin.

EXAMPLE 24

A toner is prepared in the same manner as that in Example 18 except for using 55 parts of the terpene-modified novolac resin.

EXAMPLE 25

Preparation of toner particle (Black)

| | |
|---|---|
| Binder resin (Bisphenol type polyester resin mainly comprising an ethylene oxide adduct of bisphenol A and terephthalic acid: Weight average molecular weight: $9.6 \times 10^5$, Number average molecular weight: $4.7 \times 10^3$, Tg: 65° C., η (140° C.) = 130 (Pa · s), SP value: 11.9) | 100 parts |
| Carbon black (BPL; CABOT) | 5 parts |
| Charge controlling agent (*BONTRON E84*; ORIENT KAGAKU) | 2 parts |
| Low molecular weight polypropylene (Viscol 660 P; SANYO KASEI KOGYO) | 5 parts |

The components shown above are kneaded using a Banbury mixer, cooled, finely divided using a jet mill, and then classified using a classifying machine to obtain toner particles whose volume average particle size is 6 μm. 100 Parts of these toner particles are admixed, using a Henschel mixer, with 0.5 parts of the terpene-modified novolac resin microparticle (obtained in Example 18) that has been pulverized to 0.5 μm and 1.0 parts of $TiO_2$ that had been imparted with hydrophobicity using an alkylsilane to prepare a toner.

EXAMPLE 26

A toner is prepared in the same manner as that in Example 25 except for using 5 parts of the terpene-modified novolac resin microparticle.

EXAMPLE 27

A toner is prepared in the same manner as that in Example 25 except for using 20 parts of the terpene-modified novolac resin microparticle.

EXAMPLE 28

A toner is prepared in the same manner as that in Example 25 except for using 25 parts of the terpene-modified novolac resin microparticle.

EXAMPLE 29

Preparation of toner particle (Black)

| | |
|---|---|
| Binder resin (St/nBA copolymer resin, Copolymerization ratio 80:20, <Low molecular weight component/Weight average molecular weight: $5.5 \times 10^3$, Number average molecular weight: $2.5 \times 10^3$, Tg: 60° C.> <High molecular weight component/Weight average molecular weight: $6.0 \times 10^5$, Number average molecular weight: $3.0 \times 10^5$, Tg: 60° C.> <High molecular weight/low molecular weight = 30/70> <Total: Weight average molecular weight: $2.0 \times 10^5$, Number average molecular weight: $3.6 \times 10^3$, η (140° C.) = 660 (Pa · s), SP value: 10.1>) | 100 parts |
| Carbon black (BPL; CABOT) | 5 parts |
| Charge controlling agent (*BONTRON E84*; ORIENT KAGAKU) | 2 parts |
| Low molecular weight polypropylene (Viscol 660 P; SANYO KASEI KOGYO) | 5 parts |
| Terpene-modified novolac resin (PR-12603; SUMITOMO *DURES*) | 20 parts |

The components shown above are kneaded using a Banbury mixer, cooled, finely divided using a jet mill, and then classified using a classifying machine to obtain toner particles whose volume average particle size is 6 μm. 100 Parts of these toner particles are admixed, using a Henschel mixer, with 1.0 parts of $TiO_2$, which has been imparted with hydrophobicity using an alkylsilane, to prepare a toner.

EXAMPLE 30

Preparation of toner particle (Cyan)

| | |
|---|---|
| Binder resin (Bisphenol type polyester resin mainly comprising an ethylene oxide adduct of bisphenol A and terephthalic acid: Weight average molecular weight: $6.2 \times 10^4$, Number average molecular weight: $4.7 \times 10^3$, Tg: 58° C., η (140° C.) = 95 (Pa · s), SP value: 11.2) | 100 parts |
| C.I. Pigment Blue 15:3 | 5 parts |
| Charge controlling agent (*BONTRON E84*; ORIENT KAGAKU) | 2 parts |
| *SAZOL* wax (H1-N6, supplier: KATOYOKO) | 5 parts |
| Terpene-modified novolac resin (PR-12603; SUMITOMO*DURES*) | 20 parts |

The components shown above are kneaded using a Banbury mixer, cooled, finely divided using a jet mill, and then classified using a classifying machine to obtain toner particles whose volume average particle size is 6 μm. 100 Parts of these toner particles are admixed, using a Henschel mixer, with 1.0 parts of $TiO_2$, which has been imparted with hydrophobicity using an alkylsilane, to prepare a toner.

EXAMPLE 31

Preparation of magnetic toner particle (Black)

| | |
|---|---|
| Binder resin (St/nBA copolymer resin, Copolymerization ratio 80:20, <Low molecular weight component/Weight average molecular weight: $5.5 \times 10^3$, Number average molecular weight: $2.5 \times 10^3$, Tg: 60° C.> <High molecular weight component/Weight average molecular weight: $6.0 \times 10^5$, Number average molecular weight: $3.0 \times 10^5$, Tg: 60° C.> <High molecular weight/low molecular weight = 30/70> <Total: Weight average molecular weight: $2.0 \times 10^5$, Number average molecular weight: $3.6 \times 10^3$, η (140° C.) = 660(Pa · s), SP value: 10.1>) | 100 parts |
| Magnetite (MTH009; TODA KOGYO) | 5 parts |

-continued

| | |
|---|---|
| Charge controlling agent (*BONTRON E84*; ORIENT KAGAKU) | 2 parts |
| Low molecular weight polypropylene (Viscol 660 P; SANYO KASEI KOGYO) | 5 parts |
| Terpene-modified novolac resin (PR-12603; SUMITOMO *DURES*) | 2 parts |

The components shown above are kneaded using a Banbury mixer, cooled, finely divided using a jet mill, and then classified using a classifying machine to obtain toner particles whose volume average particle size is 6 $\mu$m. 100 Parts of these toner particles are admixed, using a Henschel mixer, with 1.0 parts of $TiO_2$, which has been imparted with hydrophobicity using an alkylsilane, to prepare a toner.

EXAMPLE 32

A toner is prepared in the same manner as that in Example 31 except for using 3 parts of the terpene-modified novolac resin.

EXAMPLE 33

A toner is prepared in the same manner as that in Example 31 except for using 5 parts of the terpene-modified novolac resin.

EXAMPLE 34

A toner is prepared in the same manner as that in Example 31 except for using 10 parts of the terpene-modified novolac resin.

EXAMPLE 35

A toner is prepared in the same manner as that in Example 31 except for using 30 parts of the terpene-modified novolac resin.

EXAMPLE 36

A toner is prepared in the same manner as that in Example 31 except for using 50 parts of the terpene-modified novolac resin.

EXAMPLE 37

A toner is prepared in the same manner as that in Example 31 except for using 55 parts of the terpene-modified novolac resin.

EXAMPLE 38

Preparation of toner particle (Black)

| | |
|---|---|
| Magnetite (MTH009; TODA KOGYO) | 5 parts |
| Charge controlling agent (*BONTRON E84*; ORIENT KAGAKU) | 2 parts |
| Low molecular weight polypropylene (Viscol 660 P; SANYO KASEI KOGYO) | 5 parts |

The components shown above are kneaded using a Banbury mixer, cooled, finely divided using a jet mill, and then classified using a classifying machine to obtain toner particles whose volume average particle size is 6 $\mu$m. 100 Parts of these toner particles are admixed, using a Henschel mixer, with 0.5 parts of the terpene-modified novolac resin microparticle that has been pulverized to 0.5 $\mu$m and 1.0 parts of $TiO_2$ that has been imparted with hydrophobicity using an alkylsilane to prepare a toner.

EXAMPLE 39

A toner is prepared in the same manner as that in Example 38 except for using 5 parts of the terpene-modified novolac resin.

EXAMPLE 40

A toner is prepared in the same manner as that in Example 38 except for using 20 parts of the terpene-modified novolac resin.

EXAMPLE 41

A toner is prepared in the same manner as that in Example 3 8 except for using 25 parts of the terpene-modified novolac resin.

COMPARATIVE EXAMPLE 7

Preparation of toner particle (Black)

| | |
|---|---|
| Binder resin (Bisphenol type polyester resin mainly comprising an ethylene oxide adduct of bisphenol A and terephthalic acid: Weight average molecular weight: $9.6 \times 10^5$, Number average molecular weight: $4.7 \times 10^3$, Tg: 65° C., $\eta$ (140° C.) = 130 (Pa · s), SP value: 11.9) | 100 parts |
| Carbon black (BPL; CABOT) | 5 parts |
| Charge controlling agent (*BONTRON E84*; ORIENT KAGAKU) | 2 parts |
| Low molecular weight polypropylene (Viscol 660 P; SANYO KASEI KOGYO) | 5 parts |

The components shown above are kneaded using a Banbury mixer, cooled, finely divided using a jet mill, and then classified using a classifying machine to obtain toner particles whose volume average particle size is 6 $\mu$m. 100 Parts of these toner particles are admixed, using a Henschel mixer, with 1.0 parts of $TiO_2$, which has been imparted with hydrophobicity using an alkylsilane, to prepare a toner.

COMPARATIVE EXAMPLE 8

Preparation of toner particle (Black)

| | |
|---|---|
| Binder resin (St/nBA copolymer resin, Copolymerization ratio 80:20, <Low molecular weight component/Weight average molecular weight: $5.5 \times 10^{-3}$, Number average molecular weight: $2.5 \times 10^3$, Tg: 60° C.> <High molecular weight component/Weight average molecular weight: $6.0 \times 10^5$, Number average molecular weight: $3.0 \times 10^5$, Tg: 60° C.> <High molecular weight/low molecular weight = 30/70> <Total: Weight average molecular weight: $2.0 \times 10^5$, Number average molecular weight: $3.6 \times 10^3$, $\eta$ (140° C.) = 660(Pa · s), SP value: 10.1>) | 100 parts |
| Carbon black (BPL; CABOT) | 5 parts |
| Charge controlling agent (*BONTRON E84*; ORIENT KAGAKU) | 2 parts |
| Low molecular weight polypropylene (Viscol 660 P; SANYO KASEI KOGYO) | 5 parts |

The components shown above are kneaded using a Banbury mixer, cooled, finely divided using a jet mill, and then classified using a classifying machine to obtain toner particles whose volume average particle size is 6 $\mu$m. 100 Parts of these toner particles are admixed, using a Henschel mixer, with 1.0 parts of $TiO_2$, which has been imparted with hydrophobicity using an alkylsilane, to prepare a toner.

COMPARATIVE EXAMPLE 9

Preparation of toner particle (Cyan)

| | |
|---|---|
| Binder resin (Bisphenol type polyester resin mainly comprising an ethylene oxide adduct of bisphenol A and terephthalic acid: Weight average molecular weight: $6.2 \times 10^4$, Number average molecular weight: $4.7 \times 10^3$, Tg: 58° C., η (140° C.) = 95 (Pa · s), SP value: 11.2) | 100 parts |
| C.I. Pigment Blue 15:3 | 5 parts |
| Charge controlling agent (*BONTRON E84*; ORIENT KAGAKU) | 2 parts |
| *SAZOL* wax (H1-N6, supplier: KATOYOKO) | 5 parts |

The components shown above are kneaded using a Banbury mixer, cooled, finely divided using a jet mill, and then classified using a classifying machine to obtain toner particles whose volume average particle size is 6 μm. 100 Parts of these toner particles are admixed, using a Henschel mixer, with 1.0 parts of $TiO_2$, which has been imparted with hydrophobicity using an alkylsilane, to prepare a toner.

COMPARATIVE EXAMPLE 10

Preparation of toner particle (Black)

| | |
|---|---|
| Binder resin (Bisphenol type polyester resin mainly comprising an ethylene oxide adduct of bisphenol A and terephthalic acid: Weight average molecular weight: $9.6 \times 10^5$, Number average molecular weight: $4.7 \times 10^5$, Tg: 65° C.) | 100 parts |
| Carbon black (BPL; CABOT) | 5 parts |
| Charge controlling agent (*BONTRON E84*; ORIENT KAGAKU) | 2 parts |
| Phenol novolac resin (η (140° C.) = 100(Pa · s), SP value: 10.5, Mw = 900, PR-HF-6; SUMITOMO *DURES*) | 20 parts |
| Low molecular weight polypropylene (Viscol 660 P; SANYO KASEI KOGYO) | 2 parts |

The components shown above are kneaded using a Banbury mixer, cooled, finely divided using a jet mill, and then classified using a classifying machine to obtain toner particles whose volume average particle size is 6 μm. 100 Parts of these toner particles are admixed, using a Henschel mixer, with 1.0 parts of $TiO_2$, which has been imparted with hydrophobicity using an alkylsilane, to prepare a toner.

COMPARATIVE EXAMPLE 11

Preparation of toner particle (Black)

| | |
|---|---|
| Binder resin (Bisphenol type polyester resin mainly comprising an ethylene oxide adduct of bisphenol A and terephthalic acid: Weight average molecular weight: $9.6 \times 10^5$, Number average molecular weight: $4.7 \times 10^5$, Tg: 65° C., η (140° C.) = 130 (Pa · s), SP value: 11.9) | 100 parts |
| Carbon black (BPL; CABOT) | 5 parts |
| Charge controlling agent (*BONTRON E84*; ORIENT KAGAKU) | 2 parts |
| p-Phenylphenol novolac resin (η (140° C.) = 150 (Pa · s), SP value: 10.4, Mw = 1500, PR-NTP-1; SUMITOMO *DURES*) | 20 parts |
| Low molecular weight polypropylene (Viscol 660 P; SANYO KASEI KOGYO) | 2 parts |

The components shown above are kneaded using a Banbury mixer, cooled, finely divided using a jet mill, and then classified using a classifying machine to obtain toner particles whose volume average particle size is 6 μm. 100 Parts of these toner particles are admixed, using a Henschel mixer, with 1.0 parts of $TiO_2$, which has been imparted with hydrophobicity using an alkylsilane, to prepare a toner.

COMPARATIVE EXAMPLE 12

Preparation of magnetic toner particle (Black)

| | |
|---|---|
| Binder resin (St/nBA copolymer resin, Copolymerization ratio 80:20, <Low molecular weight component/Weight average molecular weight: $5.5 \times 10^3$, Number average molecular weight: $2.5 \times 10^3$, Tg: 60° C.> <High molecular weight component/Weight average molecular weight: $6.0 \times 10^5$, Number average molecular weight: $3.0 \times 10^5$, Tg: 60° C.> <High molecular weight/low molecular weight = 30/70> <Total: Weight average molecular weight: $2.0 \times 10^5$, Number average molecular weight: $3.6 \times 10^3$>) | 100 parts |
| Magnetite (MTH009; TODA KOGYO) | 100 parts |
| Charge controlling agent (*BONTRON E84*; ORIENT KAGAKU) | 2 parts |
| Low molecular weight polypropylene (Viscol 660 P; SANYO KASEI KOGYO) | 2 parts |

The components shown above are kneaded using a Banbury mixer, cooled, finely divided using a jet mill, and then classified using a classifying machine to obtain toner particles whose volume average particle size is 6 μm. 100 Parts of these toner particles are admixed, using a Henschel mixer, with 1.0 parts of $TiO_2$, which has been imparted with hydrophobicity using an alkylsilane, to prepare a toner.

| Carrier preparation | |
|---|---|
| Ferrite particles (average particle size: 50 μm, *POWDERTECH*) | 100 parts |
| Toluene | 14 parts |
| Styrene methyl methacrylate copolymer (SANYO KASEI) | 1 part |
| Perfluorooctylethylacrylate-methyl methacrylate copolymer (SANYO KASEI) | 1 part |
| Carbon black (R330; CABOT) | 0.2 parts |

The components listed above except for the ferrite particles are dispersed with stirring for 10 minutes using a stirrer to prepare a coating solution, which is then placed together with the ferrite particles into a vacuum degassing kneader to mix for 30 minutes at 60° C. and then further heated under reduced pressure to effect degassing and drying to obtain carrier A.

Subsequently, the toners and the carriers thus obtained are used to prepare two-component and one-component developers. 5 parts of each of toners obtained in Examples 18 to 30 and Comparative Examples 7 to 11 and 100 parts of the carrier obtained above are mixed and stirred for 20 minutes at 40 rpm using a V-shaped blender to prepare various two-component developers.

As one-component developers, the toners obtained in Examples 31 to 41 and Comparative Example 12 are employed as they are.

The various developers described above are examined for their performances in Test 1 and Test 2 described below.

Test 1:

Each of the two-component developers is subjected to the image sampling test using a modified FUJI XEROX Model A-COLOR 635 (employing as a fixing heat roll an aluminum core (ϕ35) coated with PFA (perfluoroalkoxyethylene copolymer) containing 5% SiC to a thickness of 40 μm and as a pressure roll an iron core (ϕ35) coated with SR (silicone rubber) to a thickness of 5 mm, and modified to obtain a NIP pressure of 1.5 kgf/cm$^2$ and heating temperatures of 120° C., 150° C., 180° C. and 200° C.).

Subsequently, the following performance tests are conducted.

(1) Toner heat storage performance

At 50° C., each toner is placed in a container for 24 hours, and then 20 g of the toner is mounted on a 45 μm mesh screen, which is oscillated for 90 seconds during which the toner is allowed to pass. The % amount of the toner remaining on the screen based on the amount of the entire toner is determined.

(2) Fixing characteristics

At a fixing speed of 160 mm/sec., the fixing is performed with raising the temperature stepwise from 120° C. to 200° C. to determine the difference between the offset occurrence temperature and the lowest fixing temperature as "a temperature range" in the fixing characteristics, based on which the low temperature fixing ability and the offset behavior of the toner image is evaluated. The offset occurrence temperature is the temperature at which the toner begins to adhere onto the heat roll upon fixing, and the lowest fixing temperature is the lowest temperature at which the results are judged as D2 or better, i.e., D2 or D1 when a 40 mm×50 mm solid toner fixed image is folded using a load having a certain weight and the image blank of the folded part is evaluated according to the criteria shown below.

D1: Completely no blank in image in folded part.

D2: Acceptable level with lines remaining in folded part but no blank in image.

D3: Several white lines observed in folded part and some blanks in image.

D4: Blanks in image also in areas other than folded part.

(3) Image keeping capability

On the surface of each of two papers, solid images and line images are formed in a certain layout, and then the two papers are overlaid with one imaged surface facing the other to obtain the following image overlaying patterns: 1. Solid image×Solid image, 2. Solid image×Line image, 3. Line image×Line image, 4. Solid image×Blank, 5. Line image×Blank, which are then kept for a period of 1 week to 1 month under a load of 100 g/cm$^2$ at 65° C., and then the state of the blank formed in the image is evaluated according to the criteria shown below.

Evaluation criteria

G1: Marked blanks in both of solid image and line image (X).

G2: Marked blanks especially in solid image (X).

G3: Blanks in part of line image (Δ).

G4: Inter-image adhesion without blank formation (○).

G5: No inter-image adhesion and no blank formation (○).

Test 2:

Using a modified FUJI XEROX Model Able 3321 to obtain the heating 5 temperatures of 120° C., 150° C., 180° C. and 200° C., each of the one-component developers obtained above is subjected to the image sampling test. Then the performance test similar to that described above is conducted.

The results are shown below (Table 4, 5).

TABLE 4

| | Performance of two-component developers | | | | | | | | | | | |
|---|---|---|---|---|---|---|---|---|---|---|---|---|
| | | | | | Image Keeping Capability | | | | | | | |
| | Amount of terpene-modified novolac resin added*1 | | | | Fixing temperature 120° C. | | Fixing temperature 150° C. | | Fixing temperature 180° C. | | Fixing temperature 200° C. | |
| | Content | Amount Added Externally | ① | ② | After 1 week | After 1 month | After 1 week | After 1 month | After 1 week | After 1 month | After 1 week | After 1 month |
| Example 18 | 2 parts | — | 10% | 55° C. | G3(Δ) | G2(X) | G3(Δ) | G3(Δ) | G4(○) | G3(Δ) | G4(○) | G4(○) |
| Example 19 | 3 parts | — | 9% | 60° C. | G3(Δ) | G3(Δ) | G3(Δ) | G3(Δ) | G4(○) | G4(○) | G5(○) | G4(○) |
| Example 20 | 5 parts | — | 7% | 55° C. | G3(Δ) | G3(Δ) | G4(○) | G4(○) | G5(○) | G4(○) | G5(○) | G5(○) |
| Example 21 | 20 parts | — | 5% | 50° C. | G4(○) | G4(○) | G5(○) | G4(○) | G5(○) | G5(○) | G5(○) | G5(○) |
| Example 22 | 30 parts | — | 8% | 50° C. | G5(○) | G4(○) | G5(○) | G4(○) | G5(○) | G5(○) | G5(○) | G5(○) |
| Example 23 | 50 parts | — | 12% | 40° C. | G4(○) | G4(○) | G4(○) | G4(○) | G5(○) | G4(○) | G5(○) | G5(○) |
| Example 24 | 55 parts | — | 12% | 30° C. | G3(Δ) | G3(Δ) | G5(○) | G4(○) | G5(○) | G5(○) | G5(○) | G5(○) |
| Example 25 | — | 0.5 parts | 10% | 50° C. | G3(Δ) | G1(X) | G4(○) | G3(Δ) | G4(○) | G4(○) | G5(○) | G5(○) |
| Example 26 | — | 5 parts | 7% | 45° C. | G3(Δ) | G3(Δ) | G4(○) | G3(Δ) | G5(○) | G4(○) | G5(○) | G5(○) |
| Example 27 | — | 20 parts | 3% | 45° C. | G4(○) | G4(○) | G4(○) | G4(○) | G5(○) | G5(○) | G5(○) | G5(○) |
| Example 28 | — | 25 parts | 3% | 35° C. | G4(○) | G4(○) | G4(○) | G4(○) | G5(○) | G5(○) | G5(○) | G5(○) |
| Example 29 | 20 parts | — | 3% | ≧60° C. | G5(○) | G4(○) | G5(○) | G5(○) | G5(○) | G5(○) | G5(○) | G5(○) |
| Example 30 | 20 parts | — | 10% | 50° C. | G4(○) | G4(○) | G5(○) | G5(○) | G5(○) | G5(○) | G5(○) | G5(○) |
| Comparative Example 7 | — | — | 5% | 50° C. | G1(X) | G1(X) | G1(X) | G1(X) | G3(Δ) | G1(X) | G4(○) | G1(X) |
| Comparative Example 8 | — | — | 3% | ≧60° C. | G1(X) | G1(X) | G1(X) | G1(X) | G3(Δ) | G1(X) | G4(○) | G2(X) |
| Comparative Example 9 | — | — | 8% | 50° C. | G1(X) | G1(X) | G1(X) | G1(X) | G2(X) | G1(X) | G3(Δ) | G1(X) |
| Comparative Example 10 | 20 parts*2 | — | 8% | 45° C. | G1(X) | G1(X) | G1(X) | G1(X) | G2(X) | G1(X) | G2(X) | G1(X) |
| Comparative Example 11 | 20 parts*3 | — | 6% | 55° C. | G1(X) | G1(X) | G1(X) | G1(X) | G2(X) | G1(X) | G3(Δ) | G1(X) |

TABLE 4-continued

| | Performance of two-component developers | | | | | | | | | | | | |
|---|---|---|---|---|---|---|---|---|---|---|---|---|---|
| | | | | | Image Keeping Capability | | | | | | | | |
| | Amount of terpene-modified novolac resin added*1 | | | | Fixing temperature 120° C. | | Fixing temperature 150° C. | | Fixing temperature 180° C. | | Fixing temperature 200° C. | | |
| | Content | Amount Added Externally | ① | ② | After 1 week | After 1 month | After 1 week | After 1 month | After 1 week | After 1 month | After 1 week | After 1 month |

① Toner heat storage performance
② Fixing Characteristics (temperature range)
*1Amount Added: Amount of terpene-modified novolac resin that is added to 100 parts of binder resin
*2Phenol novolac resin is added
*3p-Phenylphenol novolac resin is added.

TABLE 5

| | Performance of one-component developers | | | | | | | | | | | | |
|---|---|---|---|---|---|---|---|---|---|---|---|---|---|
| | | | | | Image Keeping Capability | | | | | | | | |
| | Amount of terpene-modified novolac resin added*1 | | | | Fixing temperature 120° C. | | Fixing temperature 150° C. | | Fixing temperature 180° C. | | Fixing temperature 200° C. | | |
| | Content | Amount Added Externally | ① | ② | After 1 week | After 1 month | After 1 week | After 1 month | After 1 week | After 1 month | After 1 week | After 1 month |
| Example 31 | 2 parts | — | 8% | 50° C. | G3(Δ) | G2(X) | G3(Δ) | G3(Δ) | G3(Δ) | G3(Δ) | G4(○) | G3(Δ) |
| Example 32 | 3 parts | — | 5% | ≧60° C. | G3(Δ) | G3(Δ) | G3(Δ) | G3(Δ) | G4(○) | G3(Δ) | G4(○) | G3(Δ) |
| Example 33 | 5 parts | — | 3% | ≧60° C. | G4(○) | G3(Δ) | G4(○) | G4(○) | G5(○) | G4(○) | G5(○) | G4(○) |
| Example 34 | 10 parts | — | 8% | 45° C. | G4(○) | G4(○) | G5(○) | G4(○) | G5(○) | G5(○) | G5(○) | G5(○) |
| Example 35 | 30 parts | — | 7% | 45° C. | G4(○) | G4(○) | G5(○) | G4(○) | G5(○) | G5(○) | G5(○) | G5(○) |
| Example 36 | 50 parts | — | 4% | 40° C. | G4(○) | G4(○) | G5(○) | G4(○) | G5(○) | G5(○) | G5(○) | G5(○) |
| Example 37 | 55 parts | — | 5% | 30° C. | G4(○) | G4(○) | G5(○) | G4(○) | G5(○) | G5(○) | G5(○) | G5(○) |
| Example 38 | — | 0.5 parts | 8% | 45° C. | G3(Δ) | G3(Δ) | G3(Δ) | G3(Δ) | G4(○) | G4(○) | G5(○) | G4(○) |
| Example 39 | — | 5 parts | 10% | 40° C. | G3(Δ) | G3(Δ) | G4(○) | G3(Δ) | G4(○) | G4(○) | G5(○) | G5(○) |
| Example 40 | — | 20 parts | 7% | 40° C. | G4(○) | G3(Δ) | G5(○) | G4(○) | G5(○) | G5(○) | G5(○) | G5(○) |
| Example 41 | — | 25 parts | 5% | 25° C. | G4(○) | G4(○) | G5(○) | G4(○) | G5(○) | G5(○) | G5(○) | G5(○) |
| Comparative Example 12 | — | — | 10% | 45° C. | G1(X) | G1(X) | G1(X) | G1(X) | G3(Δ) | G1(X) | G4(○) | G1(X) |

① Toner heat storage performance
② Fixing Characteristics (temperature range)
*1Amount added: Amount of terpene-modified novolac resin that added to 100 parts of binder resin. Content is an amount added internally into a toner.

As evident from Table 4, a two-component developer employing a toner that contains a terpene-modified novolac resin or to which this resin is added externally exhibit a markedly improved image keeping capability without affecting the toner heat storage performance adversely, when compared with a two-component developer employing a toner containing no terpene-modified novolac resin or a toner to which a simple novolac resin is added. Especially when a printed material is stored for a prolonged period, the image blank formation-preventing effect is remarkable. This effect is observed regardless of the types of binder resins or colorants. Comparing Example 18 with Example 19 and Example 23 with Example 24 reveals that, when a terpene-modified novolac resin is contained in a toner, the amount to be added is preferably 3 parts or more for the purpose of improvement in the image keeping capability after fixing at a relatively low temperature, and preferably 50 parts or less for the purpose of satisfactory fixing characteristics (usually, the span of the temperature range should be 40° C or more).

Comparing Example 25 with Example 26 and Example 27 with Example 28 reveals that when a terpene-modified novolac resin, in particular, is added externally to a toner the amount to be added externally is preferably 5 parts or more and 20 parts or less for the purpose of both of the improvement in the image keeping capability after fixing at a relatively low temperature and satisfactory fixing characteristics, similarly as above. However, when an image is fixed on a paper at 150° C. or higher, the image keeping capability can be improved regardless of the amount of a terpene-modified novolac resin added to a toner.

Table 5 indicates that, when used as a one-component developer, a magnetic toner that contains a terpene-modified novolac resin or to which this resin was added externally exhibits, as observed with two-component developers, a markedly improved image keeping capability without affecting the toner heat storage performance adversely, when compared with developers to which the terpene-modified novolac resin has not been added.

Comparing Example 31 with Example 32 and Example 36 with Example 37 reveals that, when a terpene-modified novolac resin is contained in a toner, the amount to be added is preferably 3 parts or more for the purpose of improvement in the image keeping capability, and preferably 50 parts or less for the purpose of satisfactory fixing characteristics (also in this case, the span of the temperature range should usually be 40° C. or more).

Comparing Example 40 with Example 41 reveals that when a terpene-modified novolac resin is added externally to a toner the amount to be added externally is preferably 20 parts or less for the purpose of satisfactory fixing characteristics.

However, when an image is fixed on a paper at 150° C. or higher the image keeping capability can be improved regardless of the amount of a terpene-modified novolac resin added to a toner.

A toner for electrophotography according to the present invention achieves satisfactory stability against heat, sufficient anti-offset ability upon fixing, low energy fixing, and, also in view of storage and shipping of a printed material, it is capable of maintaining an image stably over a prolonged period against heat and load. In addition, a developer for electrophotography containing such toner and a method for forming using such a developer can provide an image that is satisfactorily stable even at a high temperature and under pressure.

What is claimed is:

1. A toner for electrophotography comprising a colorant, a binder resin and a high melt viscosity resin whose weight average molecular weight is 300 to 3000 and whose melt viscosity $\eta$ at 140° C. is $10^3$ to $10^6$ (Pa·s).

2. A toner for electrophotography according to claim 1, wherein said high melt viscosity resin is contained in a toner admixture with the colorant and the binder resin.

3. A toner for electrophotography according to claim 2, wherein the difference in SP value between said binder resin and said high melt viscosity resin is 3 or less.

4. A toner for electrophotography according to claim 2, wherein said high melt viscosity resin is contained in an amount of 3 to 50 parts by weight based on 100 parts by weight of said binder resin.

5. A toner for electrophotography according to claim 1, wherein the softening point of said high melt viscosity resin is within the range from 100° C. to 150° C.

6. A toner for electrophotography according to claim 1, wherein said high melt viscosity resin is one ore more substances selected from the group consisting of novolac resins, modified novolac resins, copolymeric petroleum resins of aliphatic hydrocarbons and aromatic hydrocarbons having 9 or more carbon atoms, modified rosins, ester-derivatized modified rosins, terpene resins and C9 petroleum resins.

7. A toner for electrophotography according to claim 1, wherein said high melt viscosity resin does not have a definite endothermic peak when determined by a DSC:differential scanning calorimeter.

8. A toner for electrophotography according to claim 1, wherein said high melt viscosity resin is added externally to a toner particle.

9. A toner for electrophotography according to claim 1, wherein said high melt viscosity resin is a resin microparticle having a number average particle size of 0.05 to 1.0 $\mu$m.

10. A toner for electrophotography according to claim 8, wherein 0.3 to 20 parts by weight of said high melt viscosity resin is added externally to 100 parts by weight of said toner particle.

11. A toner for electrophotography according to claim 1, wherein said binder resin is a polyester resin.

12. A developer for electrophotography comprising a carrier and a toner according to claim 1.

13. A developer for electrophotography according to claim 12, wherein the softening point of said high melt viscosity resin is within the range from 100° C. to 150° C.

14. A developer for electrophotography according to claim 12, wherein said carrier has a resin coating layer.

15. A method for forming an image comprising: forming an electrostatic latent image on a latent image support, developing the electrostatic latent image using a developer containing a toner according to claim 1 to form a toner image on the latent image support, transferring the toner image formed on said latent image support onto a transfer material, and heat-fixing the toner image transferred onto said transfer material.

16. A method for forming an image according to claim 15, wherein the heat-fixing step is conducted using a heating roll.

17. A method for forming an image according to claim 15, wherein a heat-fixed toner image is formed on both sides of the transfer material.

* * * * *